US012674451B2

(12) United States Patent
Yao et al.

(10) Patent No.: US 12,674,451 B2
(45) Date of Patent: Jul. 7, 2026

(54) CROSSHEAD BOX AND PLUNGER PUMP

(71) Applicant: YANTAI JEREH OILFIELD SERVICES GROUP CO., LTD., Yantai (CN)

(72) Inventors: Junlei Yao, Yantai (CN); Feng Wang, Yantai (CN); Xiao Ma, Yantai (CN); Cheng Li, Yantai (CN)

(73) Assignee: Yantai Jereh Oilfield Services Group Co., Ltd., Yantai (CN)

( * ) Notice: Subject to any disclaimer, the term of this patent is extended or adjusted under 35 U.S.C. 154(b) by 184 days.

(21) Appl. No.: 18/391,143

(22) Filed: Dec. 20, 2023

(65) Prior Publication Data

US 2025/0035107 A1 Jan. 30, 2025

Related U.S. Application Data

(63) Continuation of application No. PCT/CN2023/129666, filed on Nov. 3, 2023.

(30) Foreign Application Priority Data

Jul. 26, 2023 (CN) ..... 202310922712.8
Jul. 26, 2023 (CN) ..... 202310923117.6
Jul. 26, 2023 (CN) ..... 202310923165.5

(51) Int. Cl.
*F04B 53/00* (2006.01)
*F04B 27/00* (2006.01)
*F04B 53/18* (2006.01)

(52) U.S. Cl.
CPC ..... *F04B 53/007* (2013.01); *F04B 27/00* (2013.01); *F04B 53/18* (2013.01)

(58) Field of Classification Search
CPC ..... F04B 53/16; F04B 53/18; F04B 53/22; F04B 53/006; F04B 1/00; F04B 1/0538;
(Continued)

(56) References Cited

U.S. PATENT DOCUMENTS 4,434,056 A * 2/1984 Keefer ..... B01D 61/06 210/652
9,976,544 B2 * 5/2018 Morreale ..... F04B 53/22
(Continued)

FOREIGN PATENT DOCUMENTS

CN 111022302 A 4/2020
CN 111188763 A 5/2020
(Continued)

OTHER PUBLICATIONS

Review Decision dated Nov. 10, 2025 for Chinese Patent Application No. 202310922712.8, with English translation (2 pages).
(Continued)

*Primary Examiner* — Dominick L Plakkoottam
(74) *Attorney, Agent, or Firm* — Crowell & Moring LLP

(57) ABSTRACT

The present disclosure relates to a substantially rectangular crosshead box formed by an integral forming process and provided with a front end surface, a rear end surface, an upper end surface, a lower end surface, and a side end surface. The crosshead box is provided with: a plurality of crosshead cavities, each extending in a longitudinal direction through the crosshead box body, and arranged in a transverse direction of the crosshead box. The crosshead box is further provided with a plurality of exhaust chambers, each running through the crosshead box in the longitudinal direction and being in communication with the corresponding crosshead cavity. The present disclosure further relates to a plunger pump provided with the above crosshead box. By integrally forming the crosshead box, the service life is improved, and operational air pressure inside the box body can be controlled, thereby improving the operating stability and service life.

19 Claims, 24 Drawing Sheets

(58) Field of Classification Search
CPC ..... F04B 1/0421; F04B 1/0476; F04B 19/22; F04B 53/007; F04B 53/162; F04B 53/164; F04B 27/00; F04B 39/0094; F04B 39/121; F04B 39/125; F04B 53/14; F04B 53/146; F04B 53/144
See application file for complete search history.

(56) References Cited

U.S. PATENT DOCUMENTS

| | | | | |
|---|---|---|---|---|
| 11,519,395 | B2 | 12/2022 | Zhang et al. | |
| 11,680,474 | B2 | 6/2023 | Cui et al. | |
| 12,044,234 | B2 | 7/2024 | Li et al. | |
| 12,092,101 | B2 | 9/2024 | Stephens et al. | |
| 2010/0158726 | A1* | 6/2010 | Donald | F04B 9/045 417/437 |
| 2015/0101694 | A1* | 4/2015 | Forrest | F04B 53/164 137/861 |
| 2020/0332788 | A1* | 10/2020 | Cui | F04B 1/00 |
| 2021/0131409 | A1 | 5/2021 | Cui et al. | |
| 2022/0106951 | A1* | 4/2022 | Foster | F04B 15/02 |
| 2022/0220952 | A1* | 7/2022 | Louzon | F04B 53/003 |
| 2022/0389916 | A1* | 12/2022 | Keith | F04B 15/02 |
| 2024/0110562 | A1* | 4/2024 | Kay | F04B 17/05 |

FOREIGN PATENT DOCUMENTS

| | | | |
|---|---|---|---|
| CN | 212004173 | U | 11/2020 |
| CN | 213870161 | U | 8/2021 |
| CN | 115750325 | A | 3/2023 |
| CN | 116123080 | A | 5/2023 |

OTHER PUBLICATIONS

Office Action dated Sep. 20, 2025 for Chinese Patent Application No. 202310923165.5. with English translation (20 pages).
Office Action dated Sep. 12, 2025 for Chinese Patent Application No. 202310923117.6, with English translation (16 pages).

* cited by examiner

CROSSHEAD BOX AND PLUNGER PUMP

CROSS-REFERENCE TO RELATED APPLICATIONS

This application is a continuation and claims the benefit of priority to PCT International Patent Application No. PCT/CN2023/129666, filed on Nov. 3, 2023, which is based on and claims the benefit of priority to Chinese patent applications, filed with the China National Intellectual Property Administration, with No. 202310922712.8 filed on Jul. 26, 2023, No. 202310923117.6 filed on Jul. 26, 2023, and No. 202310923165.5 filed on Jul. 26, 2023, the entire contents of which are incorporated herein by reference.

TECHNICAL FIELD

The present invention relates to a crosshead box of a plunger pump and a plunger pump provided with a crosshead box, where the crosshead box has an integrally formed structure.

BACKGROUND

Fracturing pumps (also known as plunger pumps) are widely used in the petroleum industry as important equipment that can increase oil and gas production. In particular, the fracturing pumps play an important role in the yield increase of some old oil fields in the middle and late stages and in the development of emerging shale gas.

A fracturing pump mainly includes three subsystems, namely, a reduction gearbox, a power end, and a hydraulic end. The function of the reduction gearbox is to decelerate a high rotational speed power inputted by a power source (including, but not limited to, a diesel engine, a motor, and a turbine) in a plurality of stages to become a low rotational speed power, and then input the low rotational speed power to the power end. The power end is connected between two subsystems, namely, the reduction gearbox and a hydraulic end valve box, and is responsible for converting rotational mechanical energy transmitted from the reduction gearbox into reciprocating mechanical energy, to drive liquid suction and drainage operations of the hydraulic end. The function of the hydraulic end is to pressurize a low-pressure fluid to a high-pressure fluid and output the high-pressure fluid to a high-pressure manifold.

A power end assembly mainly includes a casing, a crank connecting rod assembly, a crosshead pull rod assembly, and a lubrication system. The casing of the power end mainly includes a crankcase and a crosshead box. The crankcase is connected to one end of the crosshead box, and the other end of the crosshead box is connected to a pump head body of the hydraulic end through a connecting device. At present, common fracturing pumps in the industry are five-cylinder fracturing pumps, that is, a crankshaft of the fracturing pump is typically a six-support five-crank type integral structure. The crankshaft is connected to a big end of the connecting rod, and a small end of the connecting rod, a small end bearing pad, an axle pin, and the like are connected to a crosshead in the crosshead box. With the rotation of the crankshaft, the crossheads reciprocate in the cavities of the crosshead box, to further drive the connected plungers to reciprocate.

As a key part of the fracturing pump, the casing of the power end part is configured to carry all components of the power end and bear all loads brought by all the components of the power end during operation. Therefore, the excellent mechanical performance of the casing of the power end has a decisive influence on the service life of the fracturing pump. According to different compositions of the casing structure, casings of the power ends can be classified into an integral structure and a split type structure.

At present, the split type structure is combined and assembled by welding a crankcase and a casing of a crosshead box by using a high-strength alloy plate. A common process is completed only after undergoing steps such as welding, heat treatment (stress relief annealing), roughing, defect grinding, re-overall welding, weldment heat treatment, and testing. For example, the casing of the power end of fracturing pump developed by the FMC company adopts a split type tailor-welded structure. The power end of the 5000 thunder of the GD company also adopts a long stroke (11 inches) and split type structure design (crankcase+crosshead box split design). In addition, since welding is a rapid heating and cooling process at a partial position, a welded region is not free to expand and contract due to the constraints and restrictions of the surrounding body. Adverse consequences such as weld cracking and casing deformation may occur when the tensile stress of the material at a welding seam after cooling is close to the yield limit of the material. Although the defects at the welding seam can be relieved to a particular extent by eliminating an internal stress by using an appropriate welding process and heat treatment, the metallographic structure and mechanical properties of the base metal (heat-affected region), affected by heat but not melted, around the welding seam may change, resulting in uneven microstructure distribution under the effect of welding thermal circulation, and further inevitably leading to the welding internal stress, which becomes the source of fatigue cracks in the structural member. The application scenario and operating environment of the fracturing pump are quite harsh, and the casing of the power end may be continuously impacted by high-pressure periodic pulse loads. The impact resistance of the welded type casing of the power end is poor, and cracks are extremely apt to appear at positions near the welding seam, which further causes cracking of the casing and eventually leads to the failure of the supporting function, thereby affecting the efficiency of the fracturing operation, and even bringing about safety hazards. At present, the service life of a welded type casing of the power end is 2000 hours to 3000 hours at most, and it is difficult to exceed the designed service life (5000 hours) of the system after one failure is repaired. In addition, the gradual extension of the welding cracks may extremely reduce the internal consistency and connection strength of the supporting material, resulting in insufficient overall rigidity and strength of the casing, and the casing may deform under the action of high-pressure pulse loads. Such the abnormal casing deformation may change the clearance between the sliding surfaces, affecting the input and establishment of a lubricating oil film, and causing abnormal eccentric wear and even burns on the surfaces of key parts such as main bearings and bearing pads.

In addition, in the high-speed reciprocating movement of the power end, if a large amount of heat is not taken away in time, the internal parts including key sections such as the crankshafts, the crossheads, the pull rods, and the plungers may fail due to an excessively high temperature, so the design of the lubrication system of the power end is quite important for the continuous operation of the power end. The fracturing pump relies on reciprocating movements of the plungers in the cylinders to change the volumes of the sealed working chambers to achieve liquid suction and drainage. Therefore, the lubricating oil also has an auxiliary scaling function. The lubrication of the power end is mostly forced lubrication. An external lubrication system provides a lubricating oil of a particular pressure. In the current casing of the power end that uses a welded structure, due to the high hardness and limit thickness of the alloy plate, for the lubricating oil pathway, adding external connecting oil pipes and adding oil pipes in the casing are counted on to establish the oil pathway, so as to deliver the lubricating oil to the lubricating points (such as the crankshafts, the plurality of bearing pads, the small end bearings of the connecting rods), and then the lubricating oil is wholly or partially recovered, filtrated, and cooled, to ensure that the fracturing pump has an optimal working performance and a long service life. In such a lubricating oil pathway, a large number of high and low-pressure lubricating oil pipes need to be arranged, there are a large number of joints, and the pipeline layout is complicated. The pipeline installation process is cumbersome, and the connection reliability is difficult to control and may loosen under the pressure of the internal lubricating oil. In addition, in order to facilitate installation, the lubricating oil pipes are mostly flexible hoses, which are prone to corrosion and wear when exposed to the air for a long time, resulting in an increase in the risks of leakage. Once leakage occurs, maintenance and repair costs are high. In addition, the casing deformation caused by insufficient rigidity of the tailor-welded casing may also change the relative position of the sealing surfaces that were originally in close contact, affecting the sealing effect, causing difficulties in establishment of the pressure required for the forced lubrication, affecting the lubrication effect, and causing oil and gas leakage. The entry of water vapor caused by sealing failure may also affect the performance of the lubricating oil, change the viscosity of the oil, weaken the support strength of the oil film, and accelerate the oxidation of the oil. The hydrolysis of additives weakens or even deprives the basic properties of the lubricating oil, such as oxidation stability, extreme pressure wear resistance, and clean dispersion, resulting in the deterioration of the anti-foam performance of the oil and the generation of a large amount of foam in the lubrication system, to reduce the lubrication effect, and in severe cases, to further cause cavitation and hydrogen embrittlement effects of the metal materials.

In view of the problems existing in the above welded casing, increasing the thickness of the casing and the size of the welding angle and the like are relatively simple and reliable solutions, but the mass of the whole pump may be increased accordingly, which increases the load of the chassis/skid and wastes the transportation resources. In addition, when a casing having an excessively large wall thickness is subjected to a load, a large area of internal tissues may squeeze each other, and the stress may accumulate and cannot be released, resulting in partial stress concentration, which may also extremely affect the service life of the casing. Even if the weight can be reduced by designing grooves at positions such as the inner walls of the casing and the feet, this also extremely increases the steps of the machining process, and the removal of a large amount of materials leads to waste of the raw materials, which is not conducive to cost reduction.

In terms of production and manufacturing, the steps of the production process of the welded casing of the power end are quite complicated, usually including a series of steps such as blanking, pairing, spot welding, preheating, welding, grinding, heat treatment, flaw detection, roughing, secondary heat treatment, finishing. In this process, the manufacturing accuracy and quality of each step need to be strictly guaranteed, and otherwise it is easy to cause the accumulation and amplification of size and shape errors. The errors generated in each of the above steps may lead to an abnormal subsequent fit relationship, resulting in severe consequences such as connection failure, seal leakage, part wear, and casing vibration. Even if the error accumulation caused by the above complicated steps can be controlled and compensated by a precise machining process, the huge labor cost and time consumption caused thereby cannot be ignored and are unbearable.

SUMMARY

Technical Problems to be Solved

In view of the above problems of the tailor-welded structure, some manufacturers have proposed to use the split casting method to manufacture the crosshead box. For example, patent application no. US2022/0163034A1 filed by the KERR discloses a casing of a crosshead box manufactured by split casting. However, such a cast crosshead box has an excessively large weight and volume due to problems in such a design and manufacturing process, and is inconvenient to transport and assemble. In addition, there are some other problems, such as the stress concentration of the support points, the overall strength and rigidity are apt to fail; the overall structure is loose, resulting in a large torque during operation and reducing the service life; high and low-pressure oil pathways are jointly used in the lubrication system, resulting in that some parts are not lubricated enough and waste occurs in the other parts due to excessive oil, and therefore the overall lubrication effect is not good; the lubrication pipeline is provided externally, the process flow is increased, and the casting advantage is not well used; and the overall sealing is poor, and oil and gas leakage is apt to occur.

In view of the above problems, the present disclosure is to provide an integral crosshead box, which can give full play to the advantages of the casting integral forming process, is easy to manufacture and process, has a relatively light overall weight and high structural strength and rigidity, is equipped with a reliable and easy-to-maintain lubrication system, and has a long service life. In addition, the present disclosure is also to provide an integral crosshead box, for which a more reliable and easy-to-maintain lubrication system can be easily disposed. In addition, the present disclosure can give full play to the advantages of the casting integral forming process, is easy to manufacture and process, has a relatively light overall weight and high structural strength and rigidity, and has a long service life. In addition, the present disclosure is further expected to provide an integral crosshead box, which can give full play to the advantages of the cast integral forming process, is easy to manufacture and process, has a good internal fluid channel, has a relatively light overall weight and high structural strength and rigidity, is equipped with a reliable and easy-to-maintain lubrication system, and has a long service life.

Technical Solutions for the Technical Problems

An aspect of the present disclosure provides a crosshead box, where the crosshead box is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with a plurality of exhaust chambers, each of the exhaust chambers running through the crosshead box in the longitudinal direction of the crosshead box and being in communication with the corresponding crosshead cavity.

Preferably, a fluid channel may be formed in the front end surface of the crosshead box, the fluid channel being a groove that is recessed inwardly from the front end surface in the longitudinal direction of the crosshead box and extends from the crosshead cavities to the exhaust chambers.

Preferably, the exhaust chambers and the corresponding crosshead cavities are in fluid communication via the fluid channel, so that when crosshead assemblies move in the crosshead cavities in a direction from the front end surface to the rear end surface, an air flow in the exhaust chambers moves in a direction from the rear end surface to the front end surface, and when the crosshead assemblies move in the crosshead cavities in the direction from the rear end surface to the front end surface, the air flow in the exhaust chambers moves in the direction from the front end surface to the rear end surface.

Preferably, the crosshead box may be further provided with crosshead sliding sleeves capable of being embedded into the crosshead cavities, one end of each crosshead sliding sleeve located at the front end surface is provided with at least one inwardly recessed portion in the longitudinal direction of the crosshead box, and the inwardly recessed shape of the inwardly recessed portion matches a groove shape of the fluid channel.

Preferably, an end of the crosshead sliding sleeve at the rear end surface is provided with at least one protruding portion protruding outwards in a longitudinal direction of the crosshead sliding sleeve.

Preferably, the crosshead box may be further provided with at least one multi-functional structural hole, each of the multi-functional structural holes extending in the longitudinal direction of the crosshead box and running through the box body.

Preferably, the front end surface of the crosshead cavity may be provided with a limiting slot, an end portion of the crosshead sliding sleeve at the end of the front end surface may be provided with a positioning pin hole, the positioning pin hole and the limiting slot are matched and connected through a pin shaft that is to enter the pin hole, to axially position the crosshead sliding sleeve in the crosshead cavity.

Preferably, the crosshead box is further provided with an in-line lubricating oil pathway, the in-line lubricating oil pathway being oil holes and oil channels formed in a cast casing of the crosshead box and in communication with each other, and the in-line lubricating oil pathway including at least one primary oil pathway and at least one branch oil pathway.

Preferably, the primary oil pathway may extend in the transverse direction of the crosshead box and the branch oil pathway may extend in the longitudinal direction of the crosshead box.

Another aspect of the present disclosure provides a crosshead box, where the crosshead box is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with at least one multi-functional structural hole, each of the multi-functional structural holes extending in the longitudinal direction of the crosshead box and running through the box body.

Preferably, the multi-functional structural holes may be provided at positions close to at least one of the crosshead cavities.

Preferably, on the front end surface and the rear end surface, at least one of the multi-functional structural holes may be provided at a position between two adjacent crosshead cavities.

Preferably, on the front end surface and the rear end surface, wall surfaces around the multi-functional structural holes are equal in thickness.

Preferably, the crosshead box is further provided with an in-line lubricating oil pathway, the in-line lubricating oil pathway being oil holes and oil channels formed in a cast casing of the crosshead box and in communication with each other, and the in-line lubricating oil pathway including at least one primary oil pathway and at least one branch oil pathway.

Preferably, the primary oil pathway may extend in the transverse direction of the crosshead box and the branch oil pathway may extend in the longitudinal direction of the crosshead box.

Preferably, the in-line lubricating oil pathway may include a high-pressure lubricating oil pathway and a low-pressure lubricating oil pathway.

Another aspect of the present disclosure provides a crosshead box, where the crosshead box is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with an in-line lubricating oil pathway, the in-line lubricating oil pathway being oil holes and oil channels formed in a cast casing of the crosshead box and in communication with each other, and the in-line lubricating oil pathway including a primary oil pathway and a branch oil pathway.

Preferably, the primary oil pathway may extend in the transverse direction of the crosshead box and the branch oil pathway may extend in the longitudinal direction of the crosshead box.

Preferably, the crosshead box may further include crosshead sliding sleeves, each of the crosshead sliding sleeves has a shape matching that of the crosshead cavity and is capable of embedded and mounted in the crosshead cavity, the crosshead sliding sleeve is provided with an oil hole running through the sliding sleeve wall, and the oil hole is part of the branch oil pathway.

Preferably, the crosshead box is further provided with a plurality of exhaust chambers and at least one multi-functional structural hole, the exhaust chambers run through the crosshead box in the longitudinal direction of the crosshead box and are in communication with the corresponding crosshead cavities, and the multi-functional structural holes extend in the longitudinal direction of the crosshead box and run through the box body.

Still another aspect of the present disclosure provides a plunger pump, including a crankcase, the crosshead box according to any one of the above aspects, and a spacer frame.

Preferably, the crankcase, the crosshead box, and the spacer frame are each provided with a positioning pin hole for aligning and positioning the crankcase, the crosshead box, and the spacer frame.

Preferably, the plunger pump further includes a reduction gearbox, a supporting lug plate is provided on the mounting boss formed on the side end surface of the crosshead box, and the supporting lug plate is connected to a supporting assembly of the reduction gearbox.

Beneficial Effects

An aspect of the present disclosure provides a new integrally formed crosshead box, which greatly reduces the overall weight, and improves the strength and the rigidity. The deformation of key engagement portions is small, so that the lubrication, the sealing, and the connection are more reliable. The bending torsion resistance and the cushioning seismic performance are good, and the notch resistance sensitivity is low. In addition, the crosshead box according to an aspect of the present disclosure also has a lubrication system that is easy to manufacture, more reliable, and easy to maintain. This greatly simplifies the manufacturing process, and reduces time, labor, and raw material costs. In addition, the integrally formed crosshead box according to the present disclosure has a good internal fluid circulation passage, so that the air pressure inside the box body can always be maintained in balance during operation, thereby improving the operating stability and prolonging the service life of the equipment. In combination with the integrally crosshead box, the pump components can be improved and optimized, and a subversive fracturing pump design can be formed, and in addition, a platform development concept can be formed.

LIST OF REFERENTIAL NUMERALS

Figure 1:
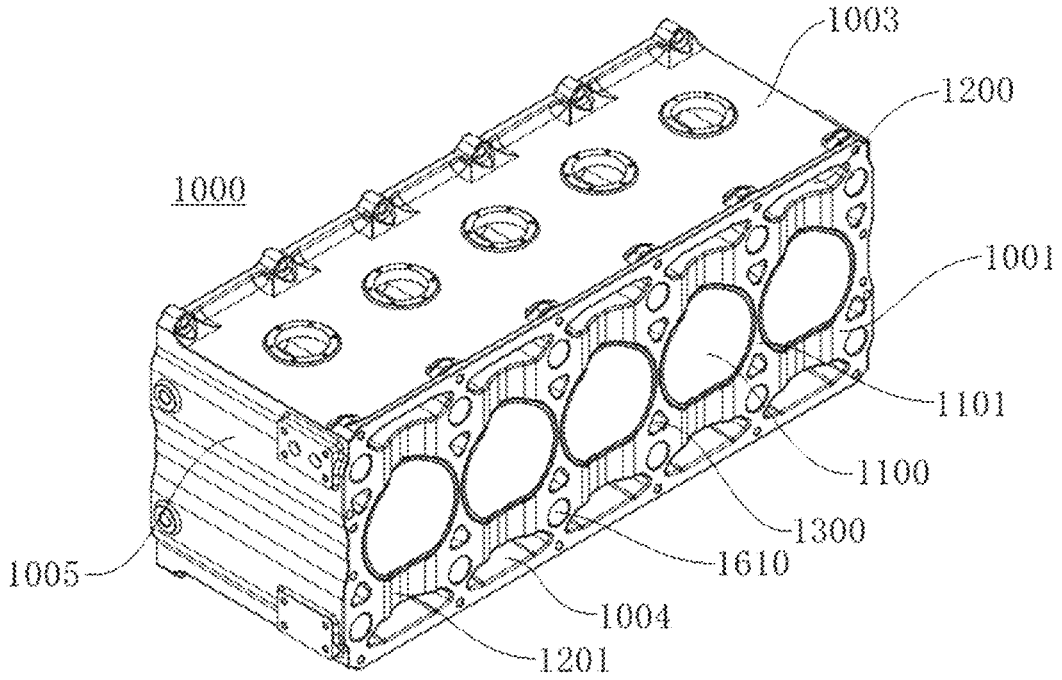
FIG. 1 is a three-dimensional diagram of a schematic structure of a crosshead box according to an embodiment of the present disclosure.

1000 crosshead box
2000 crankcase
3000 spacer frame
4000 reduction gearbox
1001 front end surface
1002 rear end surface
1003 upper mask, upper end surface
1004 lower mask, lower end surface
1005 side end plate, side end surface
1006 limiting slot
1100 crosshead cavity
1200 exhaust chamber
1300 multi-functional structural hole
1101 partition plate
1102 partition column
1400 crosshead sliding sleeve
1401 sliding sleeve oil hole
1402 sliding sleeve positioning pin hole
1403 sliding sleeve protruding portion
1404 inwardly recessed portion of sliding sleeve
1201 fluid channel
1210 reinforcing beam
1211 transition structure
1500 lubricating oil pathway
1510 high-pressure lubricating oil pathway
1520 low-pressure lubricating oil pathway
1511 high-pressure oil inlet
1512 low-pressure oil inlet
1501 relief valve
1502 oil sump end portion
1503 oil outlet
1504 boss structure
1610 first-course bolt hole
1620 second-course bolt hole
1630 third bolt hole
1611 first bolt
1701 sealing ring
1702 partial sealing member
1703 positioning pin hole
1810 auxiliary hole/observation window
1811 upward raised structure
1812 downward raised structure
1820 mounting boss
1830 supporting lug plate
1840 hoisting lug plate
2001 connecting rod movable window

DETAILED DESCRIPTION

The following describes the technical solutions of the embodiments of the present disclosure in detail below in combination with the accompanying drawings. Apparently, the described embodiments are only a part of, other than all of, the embodiments of the present disclosure. All other embodiments obtained by a person of ordinary skill in the art based on the embodiments of the present disclosure without creative efforts shall fall within the protection scope of the present disclosure.

It should be noted that, in the following detailed description, expressions such as "about" and "approximately" are used by considering factors that are understood by a person of ordinary skill in the art, such as manufacturing tolerances and machining accuracy, and will not lead to ambiguity of the description and ambiguity of the scope of protection. In addition, the orientations or positional relationships indicated by "upper", "lower", "left", "right", "front", "rear", "vertical", "horizontal", "top", "bottom", "inner", "outer", "side", and the like appearing herein are only directions defined in combination with the drawings for convenience of explanation, and it may be apparent to a person of ordinary skill in the art, upon reading this document, that an orientation corresponding to the orientation described herein can also be readily known when the equipment is turned over or moved to appear inconsistent with the orientation described herein.

It should also be noted that, in the description of the present disclosure, unless otherwise clearly defined and limited, the terms "configure", "mount", "connected", and "connection" should be understood in a broad sense, for example, the elements may be connected fixedly, or may also be connected detachably, or connected integrally; the connection may be a mechanical connection or an electrical connection; and the connection may be direct connection or indirect connection through an intermediate medium, or may be an internal communication between the two elements. For a person of ordinary skill in the art, the specific meaning of the above terms in the present invention can be understood in specific situations.

It is to be noted that the same structures, elements, or components in the drawings are denoted by the same referential numerals.

1. Overview of Crosshead Box

Figure 2:
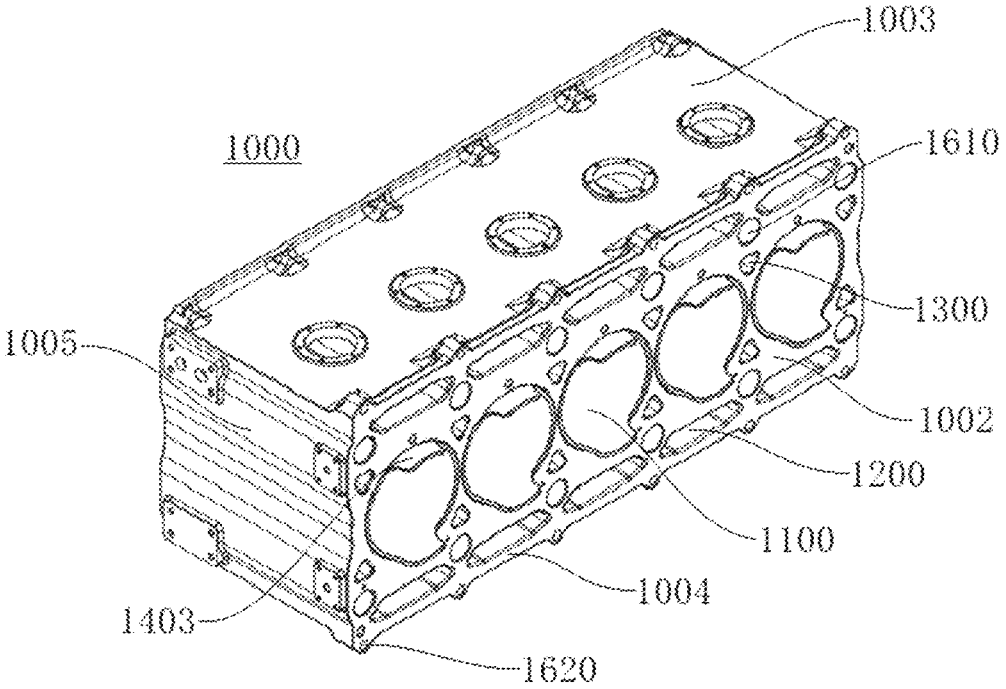
FIG. 2 is a three-dimensional diagram of a schematic structure of a crosshead box according to an embodiment of the present disclosure.

FIG. 1 and FIG. 2 are three-dimensional schematic diagram of a crosshead box 1000 according to a preferable embodiment of the present disclosure. In FIG. 1 and FIG. 2, for example, a five-cylinder crosshead box 1000 is described. However, apparently, the crosshead box 1000 of the present disclosure may also be a crosshead box 1000 having other numbers of cylinders, for example, three cylinders, or seven cylinders. As shown in FIG. 1 and FIG. 2, the crosshead box 1000 has an approximately rectangular body shape as a whole, and is integrally formed by using a casting process. The crosshead box 1000 is provided with a front end surface 1001 connected to a spacer frame 3000, a rear end surface 1002 connected to a crankcase 2000, an upper mask 1003 and a lower mask 1004 respectively located above and below a main body of the crosshead box, side end plates 1005 located on both sides of the box body, and main parts such as vertical plates located between the crosshead cavities. It is to be noted that, in the present specification, a direction in which the crossheads between the front end surface 1001 and the rear end surface 1002 reciprocate in the crosshead box 1000 is referred to as an axial direction or a longitudinal direction of the crosshead box 1000, and an arrangement direction of the plurality of crossheads in the crosshead box 1000 is referred to as a transverse direction of the crosshead box 1000. In addition, the side of the crosshead box 1000 connected to the spacer frame 3000 is referred to as the front side or the front end of the crosshead box 1000, and the side of the crosshead box 1000 connected to the crankcase 2000 is referred to as the rear side or the rear end of the crosshead box 1000. In addition, the upper mask 1003, the lower mask 1004, the side end plate 1005 mentioned herein and the partition plate 1101 to be described below are all customary names in the art for the convenience of reading by a person skilled in the art. However, it should be understood that the crosshead box 1000 in this embodiment of the present disclosure is integrally formed by using a casting process. Therefore, the upper mask 1003, the lower mask 1004, the side end plate 1005, and the partition plate 1101 herein do not mean that they are separately disposed plate members, but are all different portions of the integrally formed box body. Therefore, the upper mask 1003 may sometimes also be regarded as an upper end surface or an upper end of the crosshead box herein, the lower mask 1004 may sometimes be regarded as a lower end surface or a lower end of the crosshead box herein, and the side end plates 1003 may sometimes be regarded as side end surfaces or side ends of the crosshead box herein.

As can be seen from FIG. 1 and FIG. 2, in this embodiment of the present disclosure, the entire crosshead box 1000 is integrally formed by using a casting process. By using the casting process, the defects caused by welding are avoided, the structural rigidity is ensured, the fatigue strength of the structure is increased, and the service life is prolonged. In addition, the overall casting can greatly reduce the complexity of the process, save time, labor, and raw material costs, and improve the yield of finished products. It should be understood that although cast iron is exemplified as the casting material in this specification, other casting materials known in the art may also be selected to form the crosshead box 1000.

As shown in FIG. 1 and FIG. 2, a plurality of crosshead cavities 1100 are formed in the crosshead box 1000. The crosshead cavities 1100 extend in the longitudinal direction of the crosshead box 1000 inside the crosshead box 1000, and run through the crosshead box 1000 from the front end surface 1001 to the rear end surface 1002. The crosshead cavities 1100 are each configured to receive a crosshead assembly and a sliding sleeve to be described below. The crosshead assembly reciprocates inside the crosshead cavity 1100 in the axial direction of the crosshead box 1000. The plurality of crosshead cavities 1100 are arranged side by side in the transverse direction of the crosshead box 1000. The number of crosshead cavities 1100 depends on the number of crosshead assemblies.

Preferably, exhaust chambers 1200 are provided above and/or below the crosshead cavities 1100. Each exhaust chamber 1200 has a flat polygonal shape or an oblate shape, extends in the longitudinal direction of the crosshead box 1000 inside the crosshead box 1000, and runs through the crosshead box 1000 from the front end surface 1001 to the rear end surface 1002. The front end of the exhaust chamber 1200 is in fluid communication with an exhaust channel (to be described in detail below) provided on the front end surface 1001 of the crosshead box 1000, and the rear end of the exhaust chamber 1200 is in fluid communication with the cavity of the crankcase 2000.

Preferably, at the junction between the crosshead cavity 1100 and the crosshead cavity 1100, at least one multi-functional structural hole 1300 is provided, which is to be described in detail below. The multi-functional structural hole 1300 may have, for example, a circular or triangular shape as shown in the figure, extend inside the crosshead box 1000 in the longitudinal direction of the crosshead box 1000, and run through the crosshead box 1000 from the front end surface 1001 to the rear end surface 1002. The multi-functional structural holes 1300 may be provided in an upper portion and/or a lower portion of the crosshead box 1000 according to requirements.

Preferably, an in-line lubricating oil pathway 1500 is provided in the crosshead box 1000. Unlike the oil pathways provided by additionally connected oil pipes and hoses in the prior art, the in-line lubricating oil pathway 1500 is an oil hole and an oil channel (for example, formed by drilling) that are formed in the cast casing of the crosshead box 1000 and in communication with each other. In addition, the in-line lubricating oil pathway 1500 generally includes at least one primary oil pathway and at least one branch oil pathway.

In addition, as shown in FIG. 1 and FIG. 2, the crosshead box 1000 is also provided with portions such as a connecting hole and an observation window, which are to be described in detail below.

2. Crosshead Cavity and Sliding Sleeve

2.1 Shape of the Crosshead Cavity

Figure 3:
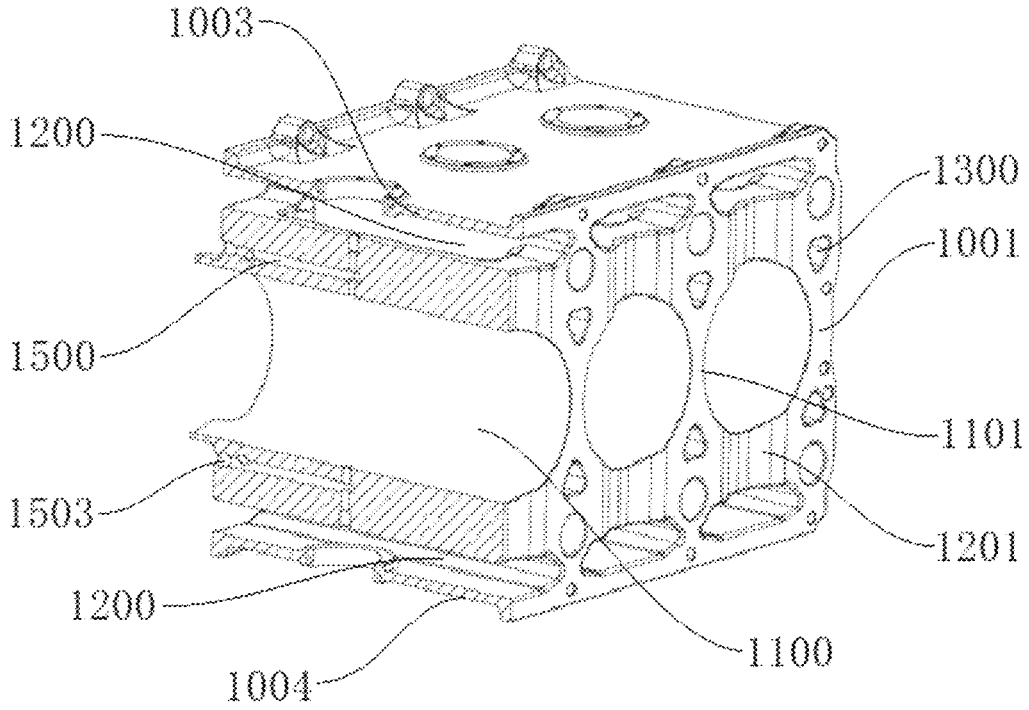
FIG. 3 is a schematic diagram of a structure of crosshead cavities of a crosshead box according to an embodiment of the present disclosure.

FIG. 3 is a schematic view of a structure of a crosshead cavity 1100 in the crosshead box 1000 according to the present disclosure. As shown in FIG. 3, the crosshead cavity 1100 has, for example, a substantially cylindrical shape. In other words, the crosshead cavity 1100 has a substantially circular shape in a cross section perpendicular to the axial direction of the crosshead box 1000. In this case, the partition plate 1101 between the crosshead cavities 1100 has a double-arc shape having thick upper and lower portions and a thin middle portion. The crosshead cavity 1100 having a cylindrical shape can reduce the box size of the crosshead box 1000, be easy to cast, and facilitate the subsequent assembling of the sliding sleeve.

Figure 4:
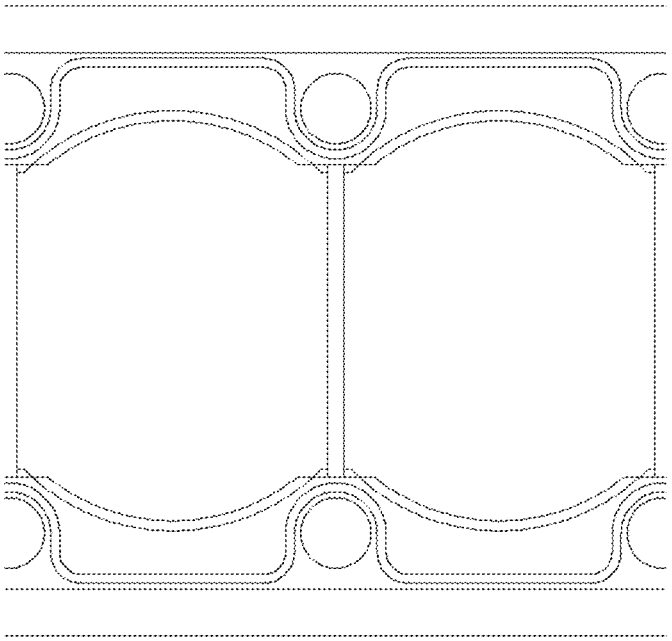
FIG. 4 is a schematic diagram of a shape of crosshead cavities of a crosshead box according to a comparative embodiment in the prior art.

In the prior art, the crosshead cavity 1100 is substantially a shape similar to a track-and-field track as shown in FIG. 4, that is, a straight-sided oval shape with straight sides on the left and right sides and arcs on the upper and lower sides. If an approximately circular crosshead cavity is formed by a welding technique, the upper and lower portions are formed to be flatter, resulting in a need for a larger inter-cylinder distance. In addition, although the "racetrack-shaped" design can theoretically reduce the contact surface pressure between the crosshead assembly and the crosshead cavity and the rectangles on both sides can reduce the spacing between the cylinders, the partial deformation under heavy load may cause the crosshead assembly and the crosshead cavity to change from surface contact to line contact, resulting in that the actual surface pressure is much greater than the theoretical value. In the crosshead box 1000 according to the present disclosure, since the integrally forming technique is used, the partition plate 1101 between the crosshead cavities 1100 and the external casing of the crosshead box 1000 including the side end plates 1005 and the upper and lower masks 1004 are integrally cast. Therefore, the crosshead cavity 1100 can be easily cast to have a substantially cylindrical shape according to requirements. In addition, since casting integral forming is used, the structural rigidity is good and the cylinder diameter requirement is easy to be met. Therefore, there is no need to use the "racetrack-shaped" design, and a simpler cylindrical shape can be used.

Figure 5A:
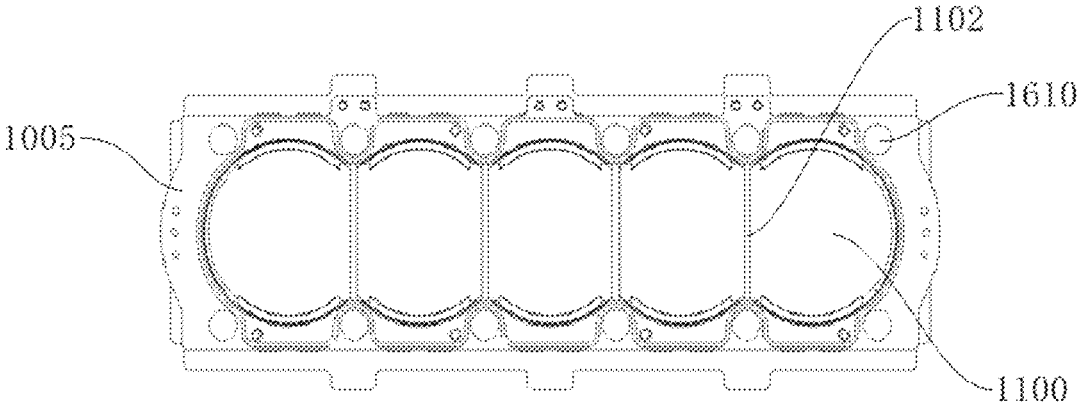
FIG. 5*a* and FIG. 5*b* are schematic diagrams of alternative examples of a structure of crosshead cavities of a crosshead box according to an embodiment of the present disclosure.
Figure 5B:
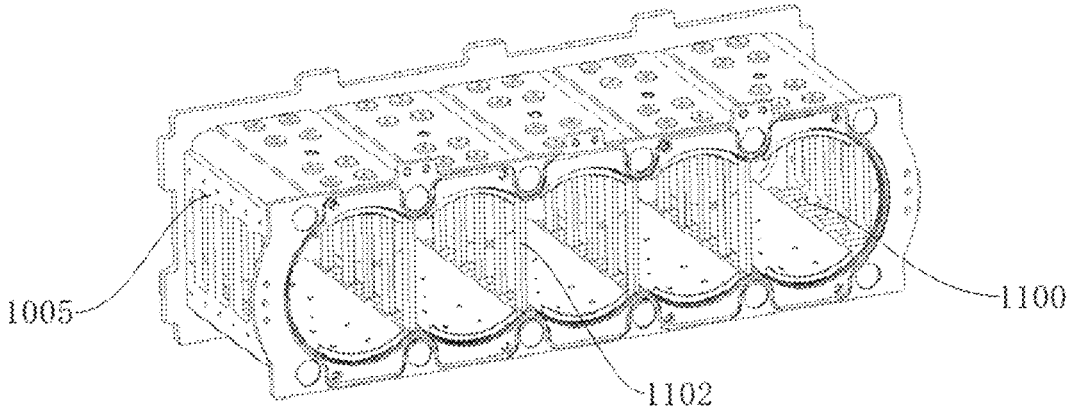

It is to be understood that the crosshead cavity 1100 according to the present disclosure can certainly also be designed in an approximately straight-sided oval shape similar to that in the prior art, as well as any other desired shapes, so that the advantages of casting are fully exerted. For example, when the crosshead cavity 1100 according to the present disclosure is designed in an approximately straight-sided oval shape similar to that in the prior art, as shown in FIG. 5*a* and FIG. 5*b*, the partition plates 1101 between the crosshead cavities 1100 may be formed as a plurality of partition columns 1102 arranged side by side and extending up and down in the axial direction of the crossheads. A gap between the partition columns allows fluid communication between two adjacent crosshead cavities 1100, which can be used for oil and gas drainage to be described in detail below. In this case, a further enhanced exhaust effect can be expected by a combined use of the exhaust chamber and the fluid channel to be described below herein. In addition, in this case, in the two crosshead cavities 1100 located at the outermost ends on both sides of the crosshead box 1000 in the transverse direction, there are also gaps between the crosshead assemblies and the side end plates 1005 on both sides of the crosshead box 1000, and the gaps can also have an oil exhaust function to be described in detail below. In addition, in this case, the sliding sleeve also uses a pad-shaped upper and lower two-piece structure commonly used in the art, which is not described again herein.

2.2 Crosshead Sliding Sleeve

Figure 6:
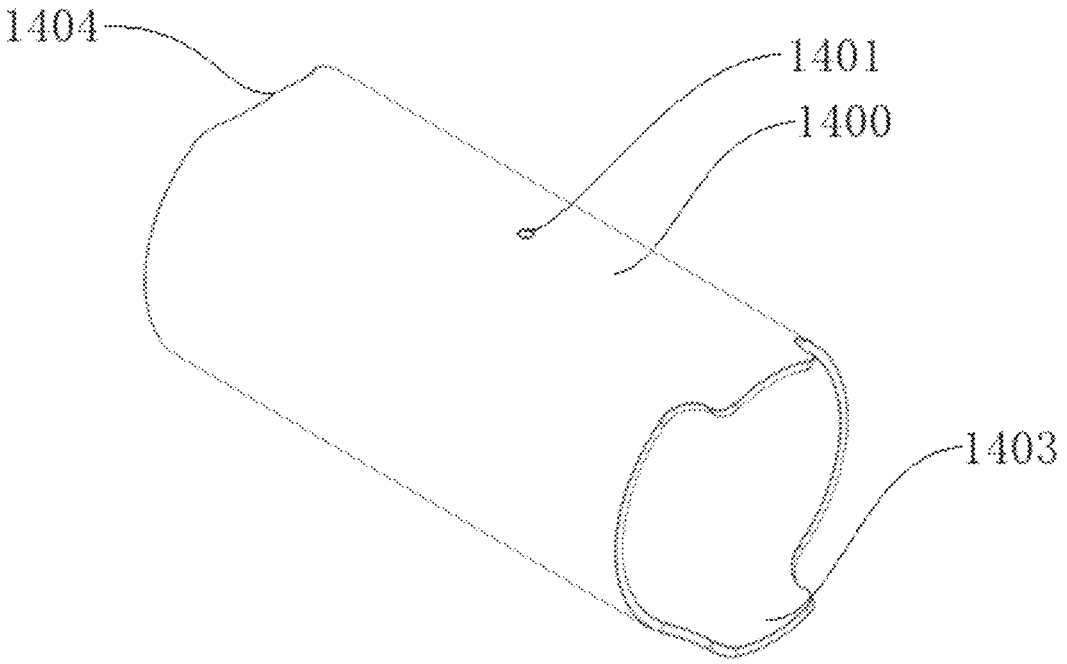
FIG. 6 is a schematic diagram of a structure of a crosshead sliding sleeve of a crosshead box according to an embodiment of the present disclosure.
Figure 7:
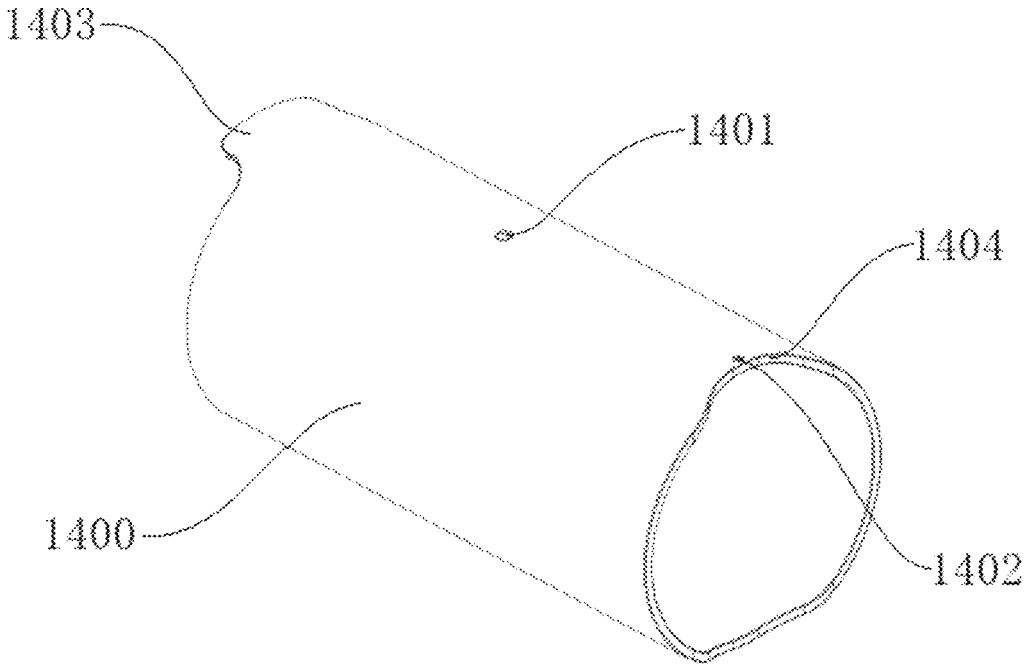
FIG. 7 is a schematic diagram of a structure of a crosshead sliding sleeve of a crosshead box according to an embodiment of the present disclosure.

A crosshead sliding sleeve 1400 is provided in the crosshead cavity 1100. The crosshead sliding sleeve 1400 is in contact with the crosshead and carries a reciprocating movement of the crosshead in the crosshead cavity 1100. In an embodiment of the crosshead box 1000 according to the present disclosure, as shown in FIG. 6, the crosshead sliding sleeve 1400 has a cylindrical shape that can be inserted into the cylindrical crosshead cavity 1100. Compared with the upper and lower two-piece split type structure mentioned above, the integral crosshead sliding sleeve 1400 can enhance the bending rigidity and the torsional rigidity of the structure, reduce the wear of the bearing pad at the crosshead position, and solve the problems such as fatigue fracture of the bearing pads. As shown in FIG. 6 and FIG. 7, the crosshead sliding sleeve 1400 is designed with a sliding sleeve oil hole 1401 running through the sliding sleeve wall. The oil hole 1401 is configured to be in fluid communication with a lubricating oil pathway to be described below, so that the lubricating oil flows into the interior of the sliding sleeve. The oil hole may be provided at any position other than the end portions of the crosshead sliding sleeve 1400 according to requirements. The position, number, and shape of the oil hole 1401 can be determined according to the lubrication requirements of the oil channels and the parts to be lubricated.

Figure 8:
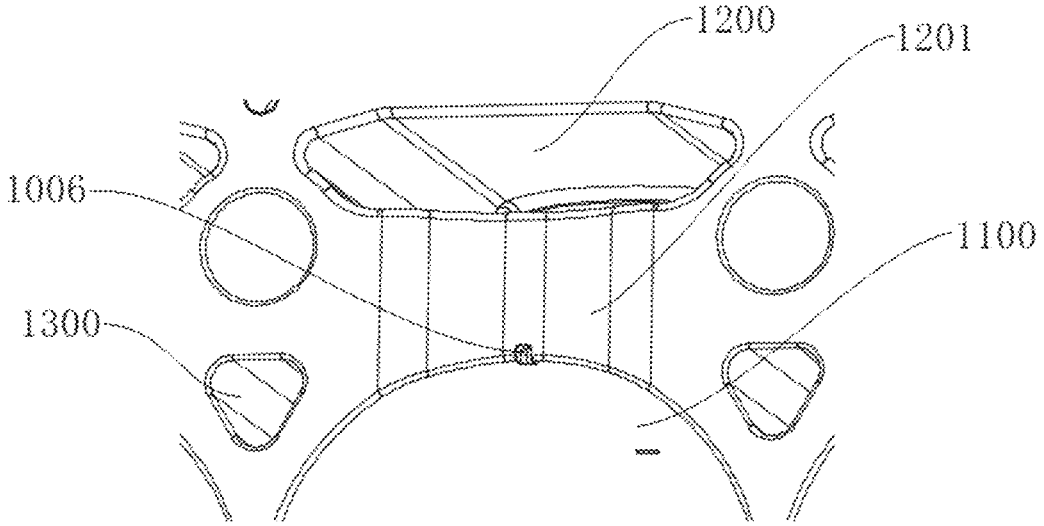
FIG. 8 is a schematic diagram of a positioning piece of a crosshead sliding sleeve of a crosshead box according to an embodiment of the present disclosure.

In addition, as shown in FIG. 7 and FIG. 8, an end portion of the crosshead sliding sleeve 1400 close to one end (that is, the front end) of the spacer frame 3000 is designed with a sliding sleeve positioning pin hole 1402, and an elastic cylindrical pin for positioning the crosshead sliding sleeve 1400 can be installed in the pin hole. The position of the pin hole 1402 is not limited, as long as the positioning requirements are met and the other structures and functions are not affected. Preferably, the pin holes 1402 should typically not be arranged at circumferentially symmetrical positions such as right above and right below, or right and left, so as to avoid difficulties in determining the correct installation angle and orientation during installation of the sliding sleeve. In the assembling process of the crosshead sliding sleeve 1400, the pin hole 1402 may, for example, be matched with a limiting slot 1006 provided in the crosshead cavity 1100 and located at the edge of the front end surface 1001 of the crosshead box 1000, so as to implement positioning of the crosshead sliding sleeve 1400 along the axial direction of the crosshead box 1000. For example, during installation, the elastic cylindrical pin is fastened and installed into the positioning pin hole 1402 of the crosshead sliding sleeve 1400, and the crosshead sliding sleeve 1400 is installed in place by axially inserting same into the crosshead cavity 1100 from the front end of the crosshead box 1000, until the side surface of the clastic pin contacts the surface of the limiting slot. In the installation process, for example, the sliding sleeve may be first cooled by using liquid nitrogen, and the thermal expansion and contraction effect may reduce the size of the sliding sleeve. The cooled sliding sleeve is then inserted into the crosshead cavity within a relatively short period of time. After the temperature of the sliding sleeve rises to the room temperature, the sliding sleeve expands in size, to produce interference fit with the crosshead cavity, so as to ensure that the sliding sleeve does not fall out of the crosshead cavity during the operation of the crosshead assembly. It should be understood that the part for positioning is not limited to the elastic cylindrical pin, and the cross-sectional size of the pin may also be adjusted according to requirements to adapt to the size change of the pin hole caused by the cold loading temperature return of the crosshead sliding sleeve 1400. The shape, position, and number of the pins and the grooves can also be selected according to actual conditions, as long as the shape, position, and number of the pins and the grooves correspond to each other. In addition, for the positioning method, other positioning methods such as first aligning the limiting slot of the crosshead box 1000 with the positioning pin hole of the crosshead sliding sleeve 1400 and then driving the positioning pin for positioning can also be used.

Figure 9:
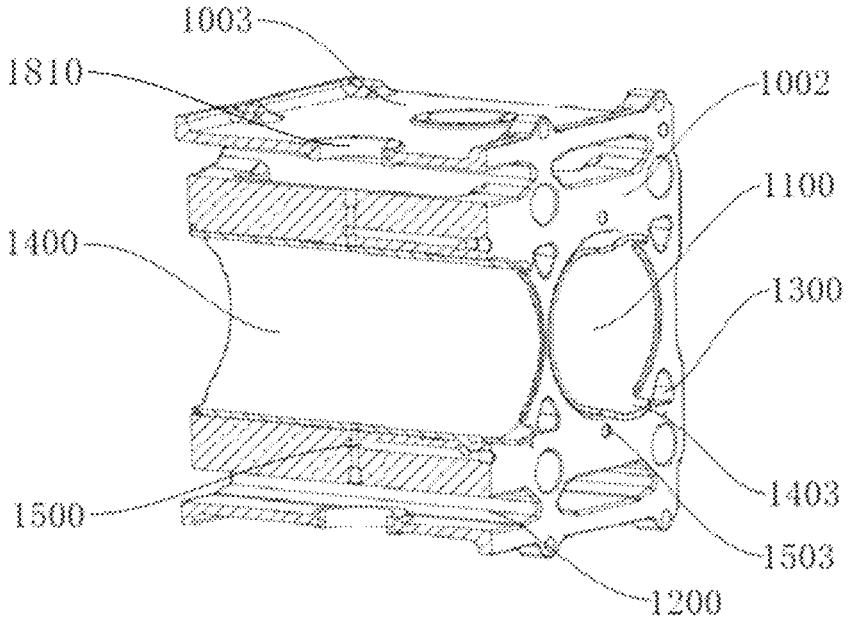
FIG. 9 is a schematic diagram of a structure of a protruding portion of a crosshead sliding sleeve of a crosshead box according to an embodiment of the present disclosure.

As shown in FIG. 7, the front end of the crosshead sliding sleeve 1400 is provided with an inwardly recessed portion 1404. The inwardly recessed portion 1404 is recessed in the axial direction of the crosshead box 1000 from the front end to the rear end of the crosshead sliding sleeve 1400, to match the shape of a groove in the front end surface 1001 of the crosshead box 1000 to be described below, so as to jointly form a fluid channel 1201 for oil and gas drainage. As shown in FIG. 7 and FIG. 9, top and bottom portions of the end (that is, the rear end), of the crosshead sliding sleeve 1400, connected to the crankcase 2000 are provided with extended protruding portions 1403, respectively. The protruding portions 1403 protrude from the rear end of the crosshead sliding sleeve 1400 to the crankcase 2000 in the axial direction of the crosshead box 1000. For example, in a state in which the crosshead sliding sleeve 1400 is installed into the crosshead cavity 1100, the inwardly recessed portions 1404 and the protruding portions 1403 are all located at the top and bottom portions of the crosshead cavity 1100, respectively. As shown in FIG. 7, a transition fillet is preferably formed in a transition region between the protruding portion 1403 and the non-protruding portion of the rear end surface 1002 of the crosshead sliding sleeve 1400, so as to maximize the rigidity at the root of the protruding portion 1403 and reduce the stress accumulation generated therein by the pressure of the sealing oil pressure in the oil sump at the bottom of the crosshead. FIG. 7 illustrates an example in which there are two inwardly recessed portions 1404 and two protruding portions 1403, but it should be understood that the numbers of the inwardly recessed portions 1404 and the protruding portions 1403 are not limited to two, and may be one or more.

Figure 10:
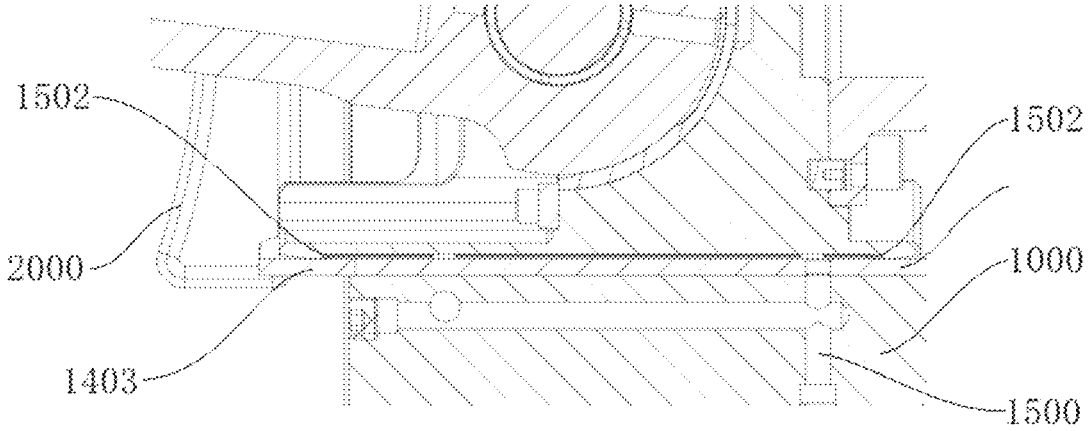
FIG. 10 is a schematic cross-sectional view of a position fitting relationship between a protruding portion of a crosshead sliding sleeve of a crosshead box and a crosshead oil sump end portion according to an embodiment of the present disclosure.

The presence of the protruding portions 1403 enables the crosshead sliding sleeve 1400 to be adapted to crosshead boxes 1000 of different length specifications, and satisfies the airtight space required for contact between the crosshead assemblies of different operating lengths and the oil film on the contact surface of sliding sleeve, thereby implementing platform-shared production of integrally formed crosshead boxes 1000 of different specifications. As shown in FIG. 10, the size of the protruding portion 1403 is correlated with the size and position of the oil sump at the bottom of the crosshead. Specifically, in an actual working state of the crosshead and the crosshead box, the protruding portion 1403 of the sliding sleeve needs to fit with the oil sump at the bottom of the crosshead to form a seal. Therefore, the size of the protruding portion 1403 of the sliding sleeve is sufficient to cover the sealing length of the oil sump at the bottom of the crosshead. In FIG. 10, the dark shade at the bottom of the crosshead indicates the oil sump at the bottom of the crosshead. The "sealing length" of the oil sump refers to the length between oil sump end portions 1502 at the two ends of the oil sump. Parts of the two ends of the oil sump other than the oil sump end portions 1502 are each fitted with the sliding sleeve 1400 to form a linear sealing structure. When the crosshead is operated in the crosshead sliding sleeve 1400 to an extreme position on the side of the crankcase, a portion of the oil sump may be outside the crosshead cavity 1100. That is, as can be seen from FIG. 10, a portion of the dark shade representing the oil sump is located outside of the crosshead cavity 1100. In this case, the presence of the protruding portion 1403 of the sliding sleeve ensures that the lubricating oil in the crosshead oil sump does not leak out under a particular pressure. In other words, the protruding portion 1403 needs to meet the sealing requirements of the oil sump end portion 1502 at a position, in the crosshead box 1000, closest to the crankcase 2000. In addition, the protruding portion 1403 can be adapted to a wide range of plungers of different lengths and plunger stroke amounts thereof, and there is no need to change the sliding sleeve 1400 to another length specification in a case that a plunger is installed within the adaptation range for a plunger stroke movement.

It should be noted that, in the crosshead box 1000 according to the present disclosure, the above provision of the crosshead sliding sleeve 1400 is preferable, but the crosshead sliding sleeve 1400 may not be provided, that is, a solution in which the inner surface of the crosshead cavity 1100 also serves as a sliding sleeve is used. The crosshead box 1000 according to this embodiment of the present disclosure is made of ductile iron by using a monolithic casting process. The spheroidization rate of the ductile iron material is high, and the ductile iron material can implement a self-lubricating function in a condition of no lubrication. If there is lubrication, the ductile iron material can not only adsorb and preserve the lubricating oil, but also can maintain the continuity of the oil film, the ductile iron material can also serve as a sliding sleeve. In this case, in order to improve the sliding effect of the crosshead, an oil storage structure such as fine reticulated patterns may be machined on the inner surface of the crosshead cavity 1100, so as to enhance the lubricating effect of the lubricating oil. Compared with the technical solution of the integral sliding sleeve made of copper mentioned in the foregoing embodiment, the ductile iron material of the crosshead cavity 1100 has a better lubrication performance, has a simpler structure, does not require high-precision installation and alignment, and therefore is more economical and cost-saving.

In addition, in the case that the inner surface of the crosshead cavity 1100 also serves as the sliding sleeve, the casting material needs to achieve the spheroidization rate required by the sliding sleeve performance, and in addition, the corresponding protruding portions 1403 and inwardly recessed portions 1404 are cast and processed. For example, preferably, a spheroidization rate is greater than 80%. In addition, the oil hole, the recess fitted with the exhaust chamber 1200 to be described below, and the part features such as the fillets and the contact surfaces which require high precision or cannot be met by casting technology can also be completed by post-machining or other common methods.

In the integrally cast crosshead box 1000, exhaust chambers 1200 are provided at positions where the upper mask 1003 and the lower mask 1004 are connected to the crosshead cylindrical cavity, for maintaining the air pressure balance in the crosshead cavity 1100 during the reciprocating movement of the crosshead assembly.

3 Exhaust Chamber and Fluid Channel

3.1 Structure of Exhaust Chamber

Figure 11:
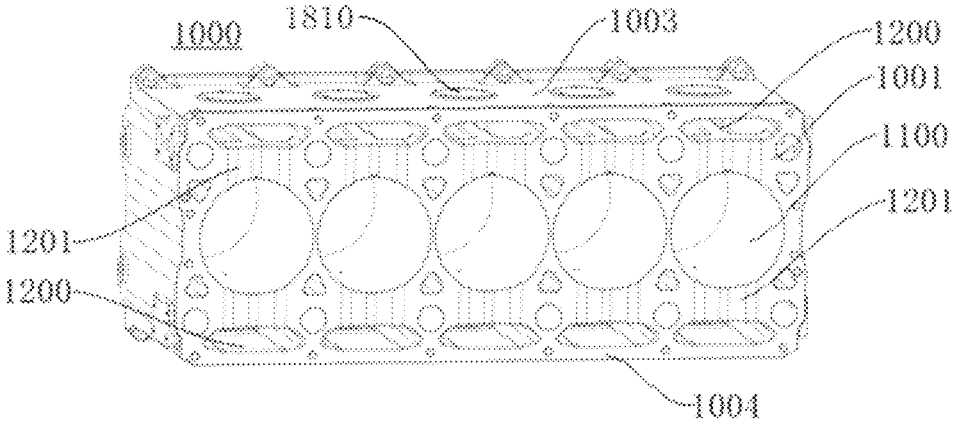
FIG. 11 is a three-dimensional schematic diagram of a configuration of exhaust chambers of a crosshead box according to an embodiment of the present disclosure.
Figure 12:
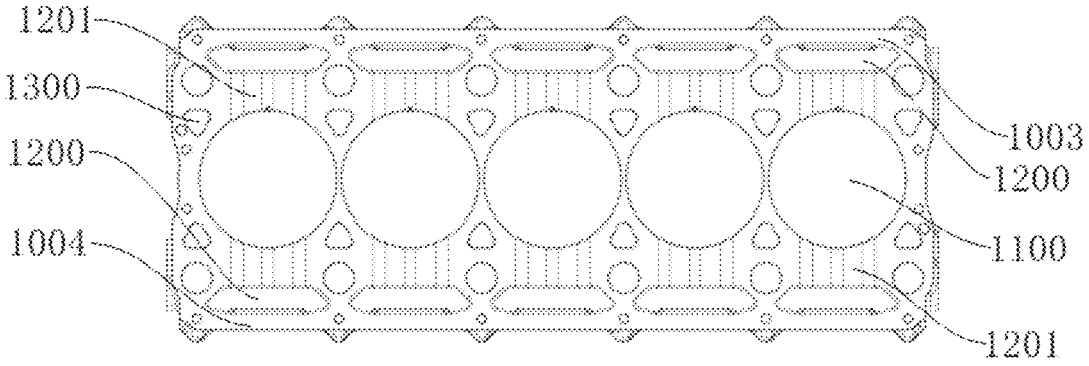
FIG. 12 is a schematic end view of a structure of exhaust chambers of a crosshead box according to an embodiment of the present disclosure.
Figure 13:
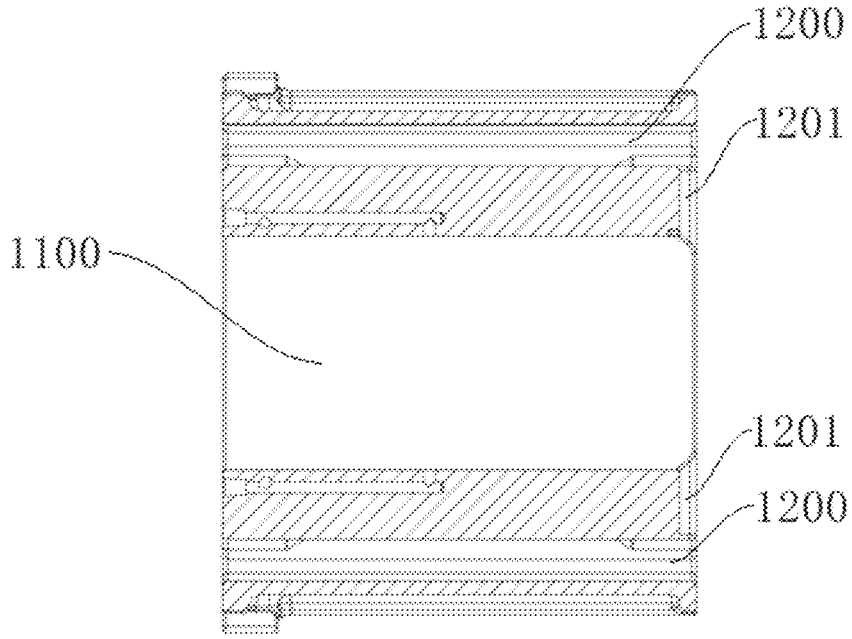
FIG. 13 is a schematic cross-sectional view of a structure of exhaust chambers of a crosshead box according to an embodiment of the present disclosure.

In the crosshead box 1000 according to this embodiment of the present disclosure, a plurality of crosshead exhaust chambers 1200 are respectively provided above and below the crosshead cavity 1100, for maintaining the air pressure balance in the crosshead cavity 1100 during the reciprocating movement of the crosshead assembly in the crosshead cavity 1100. The exhaust chamber 1200 runs through the crosshead box 1000 in the axial direction of the crosshead box 1000. The front end of the exhaust chamber 1200 is in fluid communication with the fluid channel 1201 to be described below and the rear end thereof is in fluid communication with an internal cavity of the crankcase 2000. FIG. 11 to FIG. 13 are a three-dimensional diagram, an end surface view, and a cross-sectional view of an exemplary configuration of exhaust chambers 1200 of the crosshead box 1000, respectively.

As shown in FIG. 11 to FIG. 13, the exhaust chambers 1200 may be provided, for example, between the crosshead cavity 1100 and the upper mask 1003 of the crosshead box 1000 and between the crosshead cavity 1100 and the lower mask 1004 of the crosshead box 1000. In other words, the exhaust chambers 1200 may be provided, for example, between the main body of the crosshead box 1000 in which the crosshead cavity 1100 is formed and the upper mask 1003 of the crosshead box 1000 and between the main body of the crosshead box 1000 in which the crosshead cavity 1100 is formed and the lower mask 1004 of the crosshead box 1000. The shape of the exhaust chamber 1200 can be designed according to requirements, and there is no special requirement. In this embodiment according to the figures, the exhaust chamber 1200 has, in a cross section perpendicular to the axial direction of the crosshead box 1000, a flat polygonal shape having fillets. By using such the shape, the space above and below the crosshead cavity 1100 can be fully utilized, so that the advantages of a casting process can be fully taken in the configuration of the exhaust chamber 1200, and both the exhaust requirements and the structural rigidity requirements of the box body are considered. The exhaust chambers 1200 may also be provided at other positions, as long as the structural rigidity of the box body and the structures and functions of the other parts are not affected.

It should be noted that the specific shape of the exhaust chamber 1200 is not limited to the shape shown in the figure, for example, the shape may also be circular or other regular or irregular shape. In a case that positions above and below the crosshead cavity 1100 are each provided with one exhaust chamber 1200, and the shapes of the two upper and lower exhaust chambers 1200 may be symmetrical or asymmetrical. From the perspective of guaranteeing the axial rigidity and the bending rigidity of the crosshead box 1000 as a whole, preferably, a symmetrical solution is used. The number of the exhaust chambers 1200 and the forming method are likewise not particularly limited, as long as the exhaust function to be described below is satisfied, the region affected by a bolt bearing force is avoided, and the other structures and functions are not affected. For example, only one exhaust chamber 1200 may be provided above or below each crosshead cavity. In addition, in this embodiment according to the figures, the crosshead cavity 1100 and the two exhaust chambers 1200 located above and below the crosshead cavity 1100 are centrosymmetric in the transverse direction of the crosshead box 1000, and are centrosymmetric in the vertical direction perpendicular to the transverse direction. However, the crosshead cavity 1100 and the two exhaust chambers 1200 located above and below the crosshead cavity 1100 may also be arranged to be axial-symmetric with respect to the transverse axis and the longitudinal axis, or even staggered in an asymmetrical manner according to design requirements.

3.2 Structure of Fluid Channel

Figure 14:
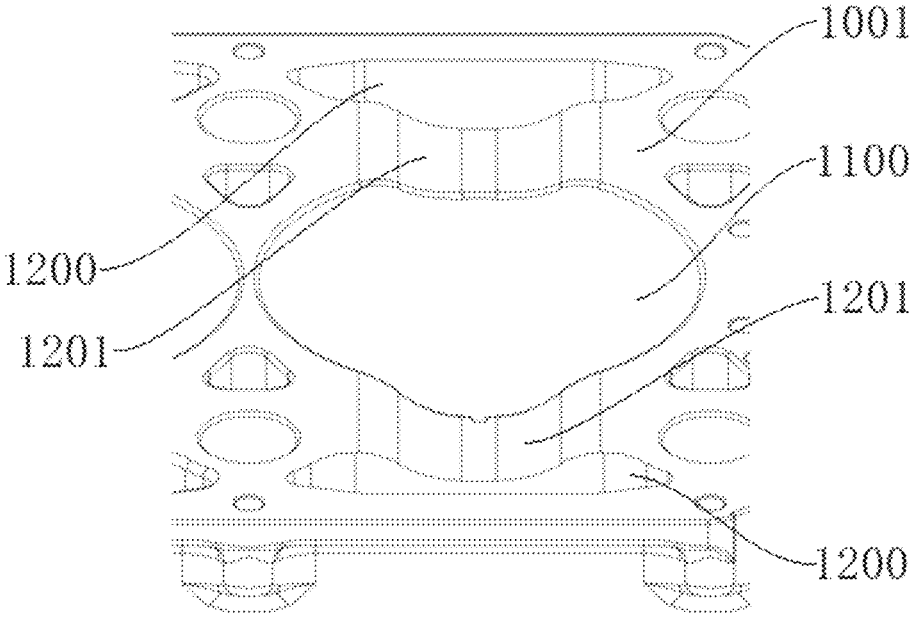
FIG. 14 is a partial enlarged view of an exemplary structure of a fluid channel at a front end surface of a crosshead box according to an embodiment of the present disclosure.

FIG. 14 is a partial enlarged view of a preferable embodiment of the fluid channel 1201 at the front end surface 1001 of the crosshead box 1000 according to an embodiment of the present disclosure. As shown in FIG. 14, at the front end surface 1001 of the crosshead box 1000 (that is, the end surface connected to the spacer frame 3000), a groove recessed inward in the axial direction of the crosshead box 1000 (that is, toward the side of the crankcase) is formed on the box body between the crosshead cavity 1100 and the exhaust chamber 1200, so that in an assembled state of the crosshead box 1000 and the spacer frame 3000, and the crosshead cavity 1100 is in fluid communication with the exhaust chamber 1200 at the end surface through such the groove. Such the groove is also referred to as the fluid channel 1201. The fluid channel 1201 and the exhaust chamber 1200 jointly constitute an exhaust channel of the crosshead box 1000, which implements the function of gas and oil (lubricating oil) drainage, to maintain the oil-gas pressure balance in the crosshead cavity 1100. In addition, the inwardly recessed shape of the inwardly recessed portion 1404 of the crosshead sliding sleeve 1400 described above matches the cross-sectional shape of the groove of the fluid channel 1201, so that in a case that the crosshead sliding sleeve 1400 is installed into the crosshead cavity 1100, the crosshead sliding sleeve 1400 does not obstruct the exhaust channel between the crosshead cavity 1100 and the exhaust chamber 1200, and the crosshead cavity 1100 is in fluid communication with the exhaust chamber 1200 via the inwardly recessed portion 1404 and the fluid channel 1201.

The groove forming the exhaust channel shown in FIG. 14 has a wave-like circular arc shape or other smooth shapes. The material extension length, of the box body, at the groove in the axial direction is different from the extension lengths of the regions on two sides of the groove due to the inwardly recessed groove formed at the end surface. Therefore, in a casting process, during transition from the groove region to the two sides of the groove region, a large internal stress is apt to occur in the vicinity of the junction transition, and in this case, the structural strength of the cast member is reduced. By using the wave-like circular arc shape or other smooth shapes, the length of the junction region can be changed gradually in a smooth manner, so that the risk of generation of a large internal stress in the vicinity of the junction region during transition from the middle region to the two side regions can be reduced, and therefore the structural rigidity can be improved.

Figure 15:
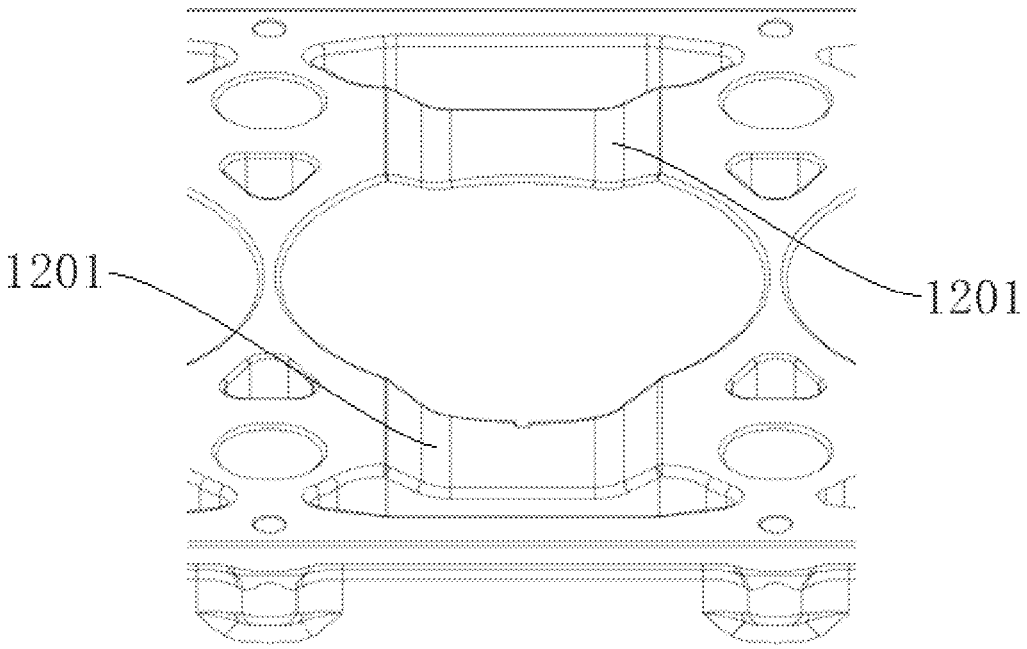
FIG. 15 is a partial enlarged view of another exemplary structure of a fluid channel at a front end surface of a crosshead box according to an embodiment of the present disclosure.
Figure 16:
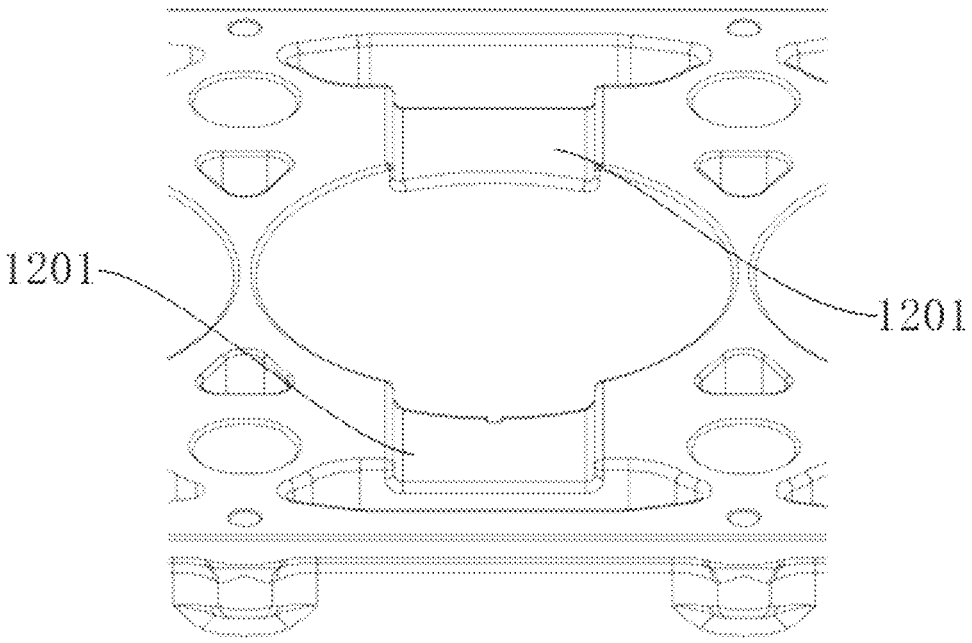
FIG. 16 is a partial enlarged view of another exemplary structure of a fluid channel at a front end surface of a crosshead box according to an embodiment of the present disclosure.

It is to be understood that apart from the wave-like circular arc shape shown in FIG. 14, the fluid channel 1201 may be formed in other shapes. For example, the fluid channel 1201 having an approximately trapezoidal cross-section is illustrated in FIG. 15. The fluid channel 1201 having an approximately rectangular cross-section is illustrated in FIG. 16. When the fluid channel 1201 has a non-arc polygonal shape such as a rectangle or a trapezoid, as shown in FIG. 15 and FIG. 16, in order to achieve the effects of reducing stress and improving structural rigidity as much as possible, the junction regions between the groove and the two side regions, that is, the recessed bending regions, are transited by using a fillet, a beveled edge, or another smooth manner as far as possible. In addition, the size of the fluid channel 1201 is not particularly limited, and may be determined according to the size of the exhaust chamber 1200 and the principle of not affecting the structures and functions of the crosshead box 1000. In addition, although only an example in which the fluid channel 1201 is formed in the front end surface 1001 of the crosshead box 1000 is shown in the drawings, it may be understood that a similar fluid channel may also be formed on the rear end surface 1002 of the crosshead box 1000, to further facilitate communication between the crosshead cavity and the exhaust chamber at the connection side of the crosshead box and the crankcase.

3.3 Function and Role of Exhaust Chamber and Fluid Channel

Figure 17:
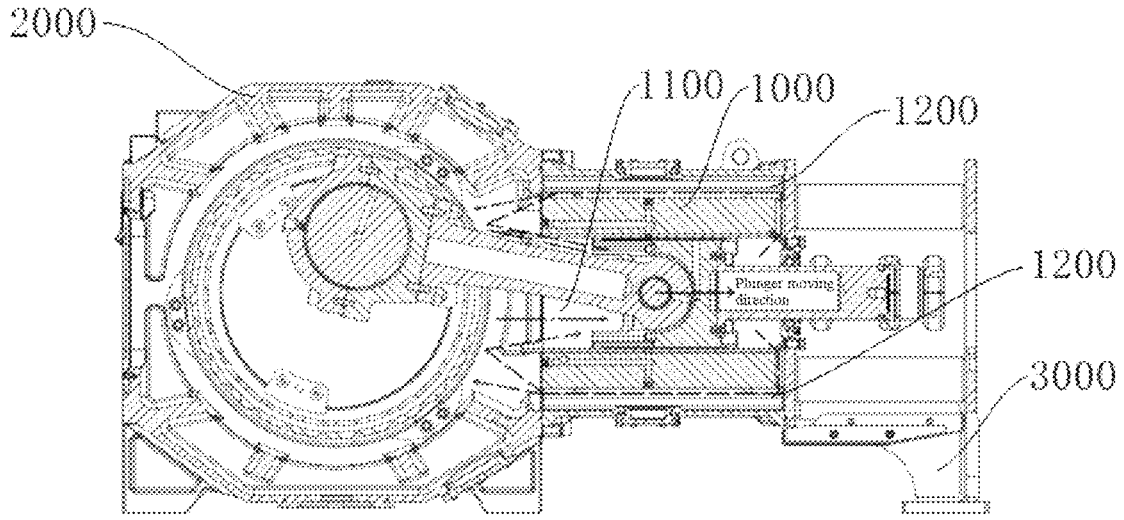
FIG. 17 is a schematic principle diagram of functions of exhaust chambers and fluid channels of a crosshead box according to an embodiment of the present disclosure.
Figure 18:
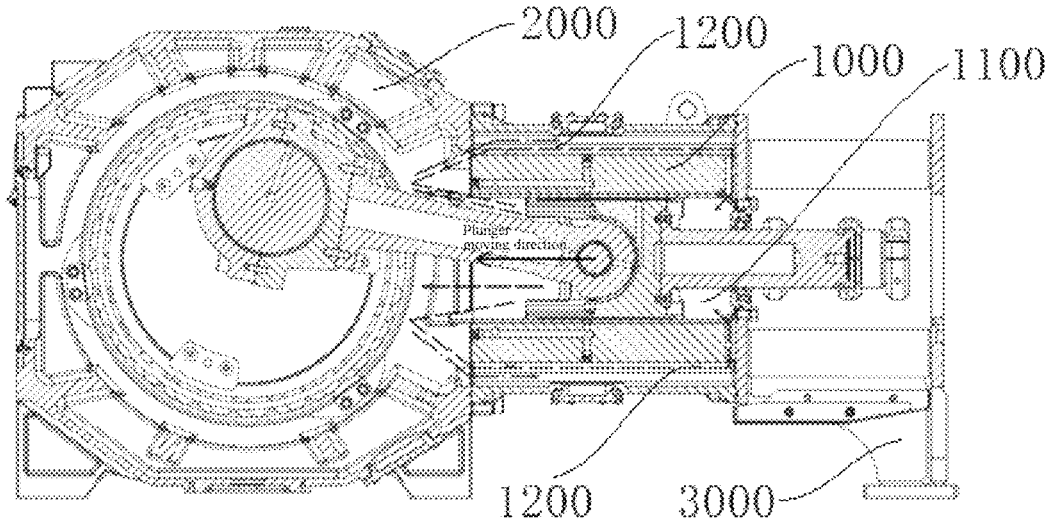
FIG. 18 is a schematic principle diagram of functions of exhaust chambers and fluid channels of a crosshead box according to an embodiment of the present disclosure.

Next, how the air exhaust chamber 1200 and the fluid channel 1201 maintain the air pressure balance in the crosshead cavity 1100 is described with reference to FIG. 17 and FIG. 18. It should be noted that FIG. 17 and FIG. 18 illustrate a state in which the crosshead box 1000 and the crankcase 2000 are engaged. In a use state, most of the internal cavities of the crosshead box 1000 and the crankcase 2000 are in fluid communication and are functionally closely correlated.

FIG. 17 illustrates a schematic diagram of a fluid flow path in the crosshead cavity 1100 during sliding of the crosshead assembly in the crosshead cavity 1100 toward the front end (the side of the spacer frame). As shown in FIG. 17, in this working condition, the pressure at the front end of the crosshead cavity 1100 gradually increases, and the oil and gas in the front end of the crosshead cavity 1100 flows upward and downward into the exhaust chambers 1200 through the fluid channel 1201 at the front end surface, and flows toward the crankcase through the exhaust chambers 1200. The oil and gas in the crankcase 2000 may enter the rear end of the crosshead cavity 1100 through a connecting rod movable window 2001 (referring to FIG. 33) of the crankcase 2000. As the crosshead continues to slide toward the front end, the space at the front end of the crosshead cavity 1100 continues to decrease, and the pressure at the front end of the crosshead cavity 1100 continues to increase. The increased pressure at the front end of the crosshead is conducted to the exhaust chambers 1200 through the fluid channel 1201, so that part of the oil and gas in the exhaust chamber 1200 enters the rear end of the crosshead cavity 1100 from the rear end of the exhaust chamber 1200 through the connecting rod movable window 2001 of the crankcase 2000, and the other part of the oil and gas in the exhaust chambers 1200 flows into the crankcase 2000 for diffusing. FIG. 18 illustrates a schematic diagram of a fluid flow path in the crosshead cavity 1100 during sliding of the crosshead assembly in the crosshead cavity 1100 toward the rear end (the side of the crankcase). As shown in FIG. 18, in a process in which the crosshead slides in the crosshead cavity 1100 toward the rear end (that is, the side of the crankcase), the pressure at the rear end of the crosshead cavity 1100 gradually increases, and the oil and gas at the rear end of the crosshead cavity 1100 may enter the crankcase 2000 and the rear end of the exhaust chambers 1200 of the crosshead box 1000 from the connecting rod movable window 2001 of the crankcase 2000. As the crosshead continues to slide toward the rear end, the pressure at the rear end of the crosshead cavity 1100 continues to increase, and such the pressure is conducted to the exhaust chamber 1200, so that the oil and gas in the exhaust chamber 1200 flows from the rear end to the front end and into the front end of the crosshead cavity 1100 through the fluid channel 1201.

As described above, the crosshead box 1000 according to the present disclosure is integrally formed by using a casting process, and therefore it is possible to provide an exhaust channel that runs through the crosshead box 1000 in the axial direction of the crosshead box 1000 and the fluid channel 1201 that is located at the front end surface 1001 of the crosshead box 1000 in the vicinity of the crosshead cavity 1100, so that self-circulation and flowing of the oil (the lubricating oil) and gas in the crosshead cavity 1100 can be implemented through the fluid channel 1201, the exhaust chambers 1200, and the connecting rod movable window 2001 without providing external circulation equipment, and that the crosshead cavity 1100 maintains air pressure balance during the reciprocating movement of the crosshead assembly. The dedicated fluid channel 1201 and exhaust chambers 1200 also reduce the noise generated by the high speed flow of gas during the reciprocating movement of the crosshead assembly, and also facilitate assembling and disassembling of the parts.

In addition, it is also conceivable to form an exhaust chamber in fluid communication with the crosshead cavity 1100 in other designs or forming methods, so as to achieve the purpose of balancing the air pressure. For example, the front and rear ends of the crosshead cavity 1100 may be fluidly connected by openings or channels formed at other positions inside the crosshead box 1000 to assist in exhaust. The manners in which such holes and channels are formed are not limited, as long as the positions do not affect the crosshead assembly, the cavity supporting structure, and the bolt fastening function.

4 Reinforcing Beam and Multi-Functional Structural Hole of the Crosshead Box

The crosshead box 1000 according to this embodiment of the present disclosure is integrally formed by using a casting process. In order to overcome the disadvantage of heavy weight commonly found in conventional cast members, the crosshead box 1000 according to this embodiment of the present disclosure is specially optimized in terms of rigidity enhancement and weight reduction of the crosshead box 1000, so that the weight of the crosshead box 1000 according to this embodiment of the present disclosure is reduced, while ensuring the structural rigidity, by 10% to 16% compared with the crosshead box 1000, of the same grade, formed by a welding process.

These structural optimization features of the crosshead box 1000 according to this embodiment of the present disclosure is to be described in detail below with reference to the accompanying drawings.

4.1 Reinforcing Beam

Figure 19:
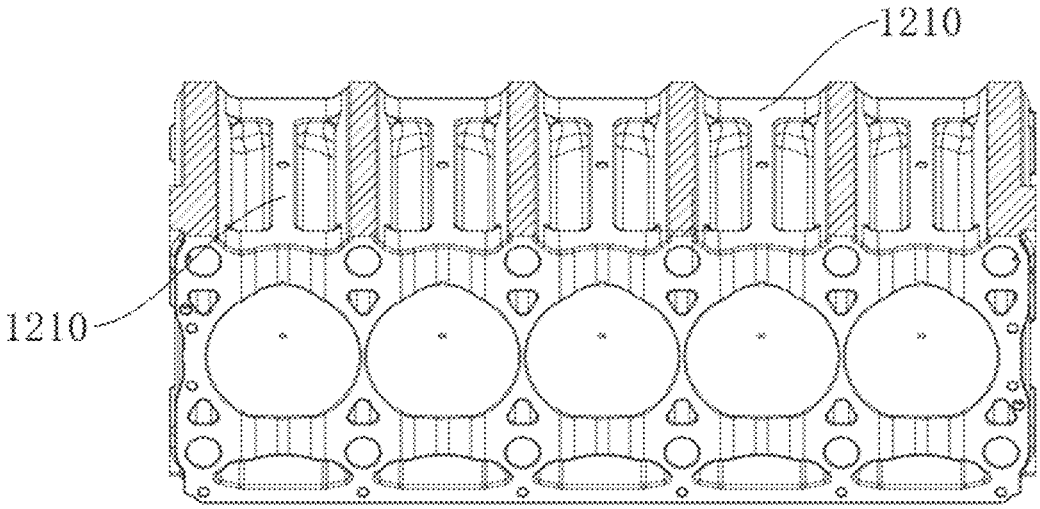
FIG. 19 is a schematic diagram of a structure of reinforcing beams of a crosshead box according to an embodiment of the present disclosure.

As shown in FIG. 19, in the exhaust chamber 1200, in order to reduce the weight of the crosshead box 1000, the box forming material is thinned at a portion of the main body of the crosshead box corresponding to the crosshead cavity 1100 (that is, the inner wall of the exhaust chamber 1200 on the side of the crosshead cavity 1100). Reinforcing beams 1210 are arranged only on the front and rear end surfaces 1002 and between the front and rear end surfaces 1002, so as to form a plurality of "I-shaped" frame structures to improve the overall bending rigidity, ensure the rigidity and stability of the crosshead cavity 1100, and prevent relative displacement and deformation. It should be noted that, for clarity of illustration, the upper mask 1003 is omitted in FIG. 19 and subsequent related drawings, and only the main body of the crosshead box 1000 is illustrated. In addition, it is easily conceivable that although only the reinforcing beams in the upper portion of the crosshead cavity 1100 are illustrated in FIG. 19, apparently, the same or similar reinforcing beam structure may be formed in the exhaust chamber 1200 below the crosshead cavity 1100.

Figure 20:
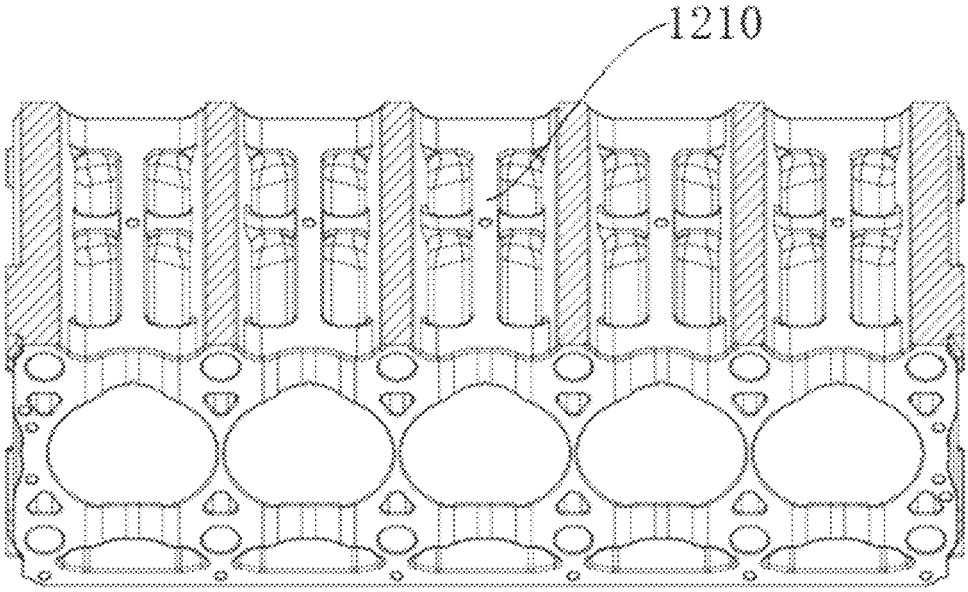
FIG. 20 is a schematic diagram of another structure of reinforcing beams of a crosshead box according to an embodiment of the present disclosure.

In this embodiment, reinforcing beams 1210 are provided in both the upper and lower exhaust chambers 1200. In addition to the I-shaped reinforcing beams 1210 shown in FIG. 19, the reinforcing beams 1210 may have a frame structure of another shape. The numbers, angles, and positions of the longitudinal reinforcing beams 1210 extending along the axial direction of the crosshead box 1000 and the transverse reinforcing beams 1210 extending along the transverse direction of the crosshead box 1000 are not limited, as long as the reinforcing beams can implement a supporting function and do not affect the arrangement of the lubricating oil pathway and the bolt arrangement to be described below. For example, FIG. 20 illustrates 工-shaped reinforcing beams 1210. The added middle cross beams further enhance the support rigidity of the middle portion of the crosshead box 1000. In addition, reinforcing beams 1210 having a structure of, for example, a "II" shape, a "III" shape, a "⊞" shape, or a "目" shape may be used. The forming method of the reinforcing beams 1210 is not limited to casting, and machining or other methods may also be used. In addition, other structures can also be used for supporting the crosshead assembly, for example, irregular support plates are provided on the upper and lower sides or one side.

Figure 21:
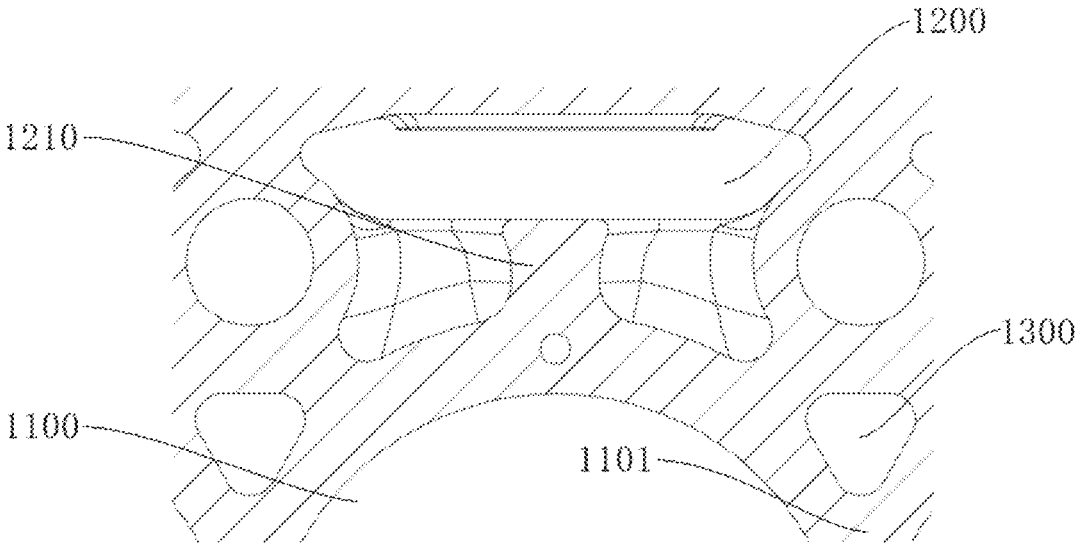
FIG. 21 is a cross-sectional view of an example of a cross-sectional shape of reinforcing beams of a crosshead box according to an embodiment of the present disclosure.

As shown in FIG. 21, the cross section of the reinforcing beams 1210 has a substantially rectangular shape, but the cross section may alternatively be another shape such as a triangle, a trapezoid, or a circle. Preferably, a rectangle is used. A long axis of the rectangle has a larger moment of inertia of section than other solid regular cross-sections of the same area (for example, a circle, a trapezoid, or a triangle), which can ensure that the reinforcing ribs have a sufficient bending rigidity and inhibit displacement and deformation between the partition plates 1101 between the crosshead cavities 1100.

Figure 22:
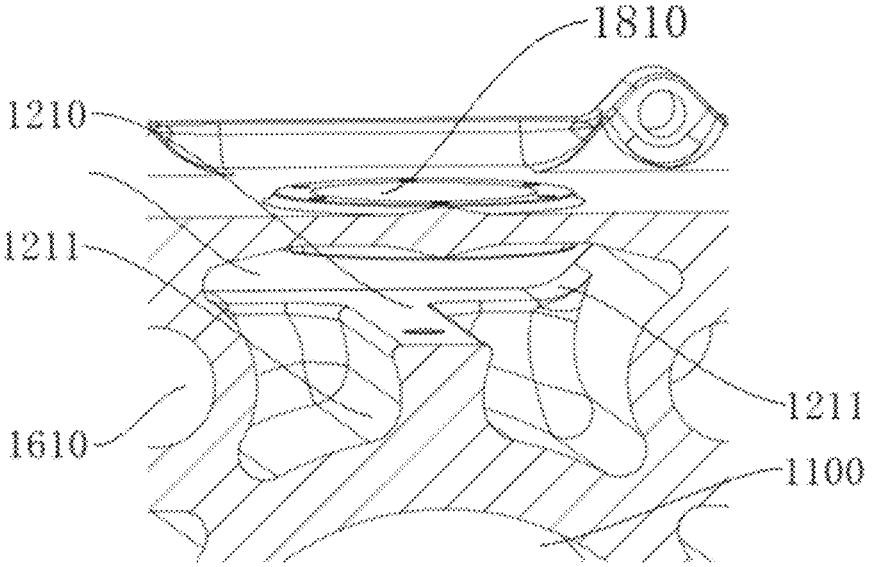
FIG. 22 is a schematic diagram of a structure of a transition region of reinforcing beams of a crosshead box according to an embodiment of the present disclosure.

In addition, as shown in FIG. 22, a fillet transition structure 1211 is provided at the junction between the reinforcing beam 1210 and the first-course bolt hole 1610 to be described below, and a fillet transition structure 1211 is also provided at the junction between the root of the reinforcing beam 1210 and the main body of the crosshead box 1000. The fillet transition structure 1211 can increase the bending strength of the corresponding part, reduce the stress concentration, and meet the requirements of the casting process. The size and shape of the fillets are mainly affected by the shape and position of reinforcing beams 1210 and bolt holes. For example, the transition fillet at the junction between the reinforcing beam 1210 and the bolt hole needs to be concentric with the bolt hole as much as possible, to gently transit to the upper surface of the reinforcing beam 1210. The transition fillet at the junction between the root of the reinforcing beam 1210 and the main body of the crosshead box 1000 may smoothly transit to the main body of the crosshead box 1000 at the root of the reinforcing beam 1210 according to the shape of the reinforcing beam 1210, so that the overall extension arc remains concentric with the arc section of the inner wall of the crosshead cavity 1100. In actual fillet processing, the bevel or arc (equal curvature or variable curvature) may be set according to requirements.

4.2 Multi-Functional Structural Hole

Figure 23:
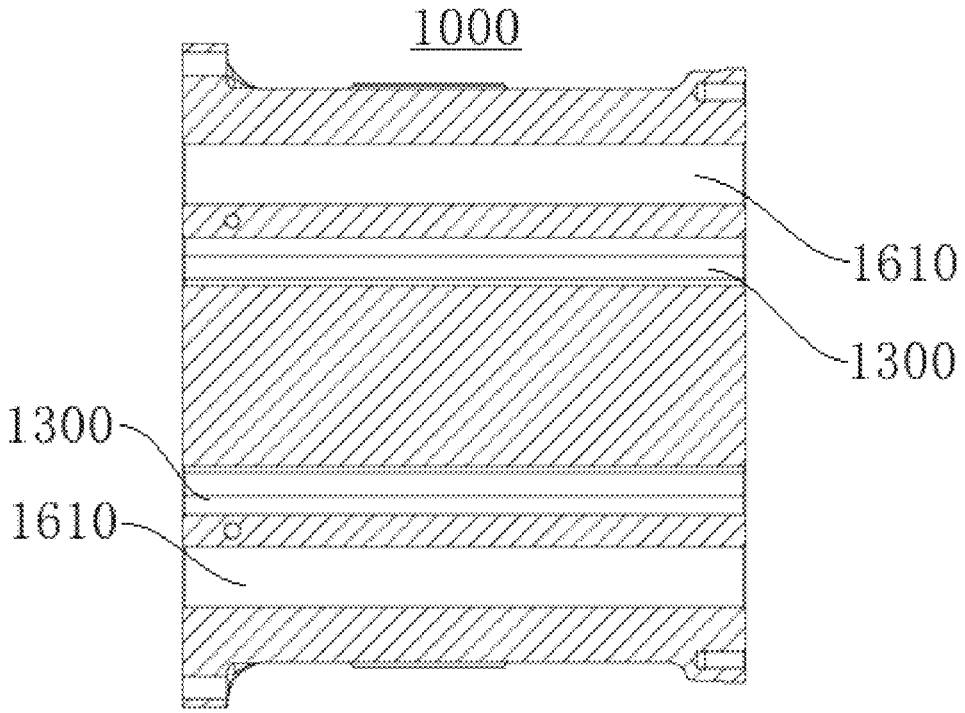
FIG. 23 is a cross-sectional view of a structure of a multi-functional structural hole of a crosshead box according to an embodiment of the present disclosure.

As described above, in the crosshead box 1000 according to this embodiment of the present disclosure, at least one multi-functional structural hole 1300 is further provided. As shown in FIG. 1 and FIG. 2, preferably, a plurality of multi-functional structural holes 1300 are arranged, for example, in portions, of the crosshead box 1000, close to the crosshead cavities 1100 and having a relatively large thickness. For example, in addition to the outermost side ends of the crosshead box 1000, the multi-functional structural holes 1300 may be arranged, for example, at a shoulder between two crosshead cavities 1100. FIG. 23 illustrates a longitudinal cross-sectional view of the multi-functional structural hole 1300 taken along the axial direction of the crosshead box 1000. As can be seen from the figure, the multi-functional structural holes 1300 run through the crosshead box 1000 along the axial direction of the crosshead box 1000. As shown in the figure, an outer side of the multi-functional structural hole 1300 is provided with a first-course bolt hole to be described below. Preferably, as shown in FIG. 1, FIG. 2, and FIG. 22, each multi-functional structural hole 1300 may be disposed at the shoulder position between two crosshead cavities 1100 in a manner of being centrally aligned with the first-course bolt hole located on the outer side of the multi-functional structural hole 1300 in a direction perpendicular to the transverse direction of the crosshead box, so as to enable the stress distribution to be more uniform. Certainly, according to specific design requirements, the multi-functional structural hole 1300 and the first-course bolt hole may also be misaligned, but staggered by a particular distance from each other. In addition, given the circular shape of the crosshead cavity 1100 on both sides of the multi-functional structural hole 1300 and the lubricating oil pathway (for example, the circular hole shown in FIG. 23) to be avoided inside the crosshead box 1000, although the multi-functional structural hole 1300 can have any polygonal cross-sectional shape, preferably, the multi-functional structural hole 1300 has a triangular shape having fillets and can be designed to have an appropriate size. Through the selection of the shape and size, the wall surface of the functional structure around the multi-functional structural hole 1300 can be made uniform in thickness, that is, the thickness is substantially consistent. For example, a triangular multi-functional structural hole 1300 is provided at the shoulder between two crosshead cavities 1100, a vertex angle of the multi-functional structural hole 1300 located at the upper shoulder of the crosshead cavity 1100 is directed downward, and a vertex angle of the multi-functional structural hole 1300 located at the lower shoulder of the crosshead cavity 1100 is directed upward, so as to ensure that the two adjacent crosshead cavities 1100 have the same wall thickness, thereby avoiding damage to the crosshead box 1000 due to offset support during operation. Two multi-functional structural holes 1300 symmetrical up and down may also be arranged at the transversely outermost edge of the crosshead box 1000, so as to ensure that the crosshead cavities 1100 receive a uniform force. Certainly, in actual design, the shape of the multi-functional structural hole 1300 may also be other shapes such as a circle or a rhombus, as long as the casting structure requirements are met.

By providing the multi-functional structural hole 1300 at a portion having a relatively large thickness between two crosshead cavities 1100, the weight of the entire crosshead box 1000 can be greatly reduced, while the structural rigidity requirements are met. In addition, because the multi-functional structural hole 1300 is also located in the region between the crosshead cavity 1100 and the bolt hole, the stress on the crosshead cavity 1100 and the bolt hole can be released at this hole, so as to avoid structural damage caused by squeezing of the internal tissue around the multi-functional structural hole 1300. In addition, the multi-functional structural hole 1300 can also have a function of anti-shrinkage in casting processing. In a casting process, hot cracking and cold cracking often occur. Condensation starts after a liquid metal is injected into a forming cavity. After a crystalline skeleton is formed and linear shrinkage starts, generation of stress or plastic deformation may occur in the cast member due to the fact that the internal molten steel is not completely solidified and the shrinkage is hindered. In a case that the stress or deformation exceeds a strength limit of the material at such a high temperature, the cast member may crack, namely, hot cracking. Cold cracking refers to cracking caused by that the partial casting stress is greater than the ultimate strength of the alloy after the casting is cooled to the elastic state after solidification. Cold cracking always occurs in portions which bear tensile stress during the cooling process, especially a portion where the tensile stress is concentrated. Therefore, the casting process also needs to provide an anti-shrinkage structure to avoid casting defects, so as to ensure that the wall surface of the cylindrical crosshead cavity 1100 is uniform, and reduce the stress concentration.

Therefore, by the crosshead box 1000 according to this embodiment of the present disclosure, by providing the multi-functional structural holes 1300 between the bolt holes and the crosshead cavities 1100, not only the weight of the crosshead box 1000 is greatly reduced and the stress concentration of the crosshead cavities 1100 and the bolt holes in a use state is reduced, but also the possibility of cold cracking and hot cracking of the forming material around the bolt holes and the crosshead cavities 1100 in the casting process of the crosshead box 1000 is greatly reduced, thereby providing a structural and functional guarantee for the design of the crosshead box 1000.

It should be noted that, in the case that the partition columns 1102 are provided between the crosshead cavities 1100 to replace the partition plates 1101, as shown in FIG. 5*a* and FIG. 5*b*, although not shown in the figures, apparently, multi-functional structural holes 1300 may also be formed at similar positions.

4.3 Side End Plates of the Crosshead Box

Side end plates 1005 on both sides of the crosshead box 1000 each may also have a curved shape, to reduce the overall weight of the crosshead box 1000 and to enable the wall thickness of the crosshead cavity 1100 to be uniform as much as possible, so as to reduce the stress concentration. The side end plates 1005 may alternatively have other structural features, such as grooves or a plurality of cut cross sections, to achieve a similar effect.

5. Lubricating Oil Pathway

In a conventional crosshead box 1000 manufactured by a welding process, the lubricating oil pathway can only be provided through an additionally provided oil pathway pipeline. The hardness and density of an alloy plate are large and the thickness is limited, and therefore it is difficult to form an oil pathway inside the plate by drilling and other processes. By using the crosshead box 1000 according to the present disclosure, a casting process is used, the casing is made of a material having a relatively low hardness such as ductile iron, and by using the casting process, partial thicknesses of parts can be controlled flexibly, so that it possible to directly provide an in-line oil pathway structure in the casting material for forming the integral crosshead box.

Figure 24:
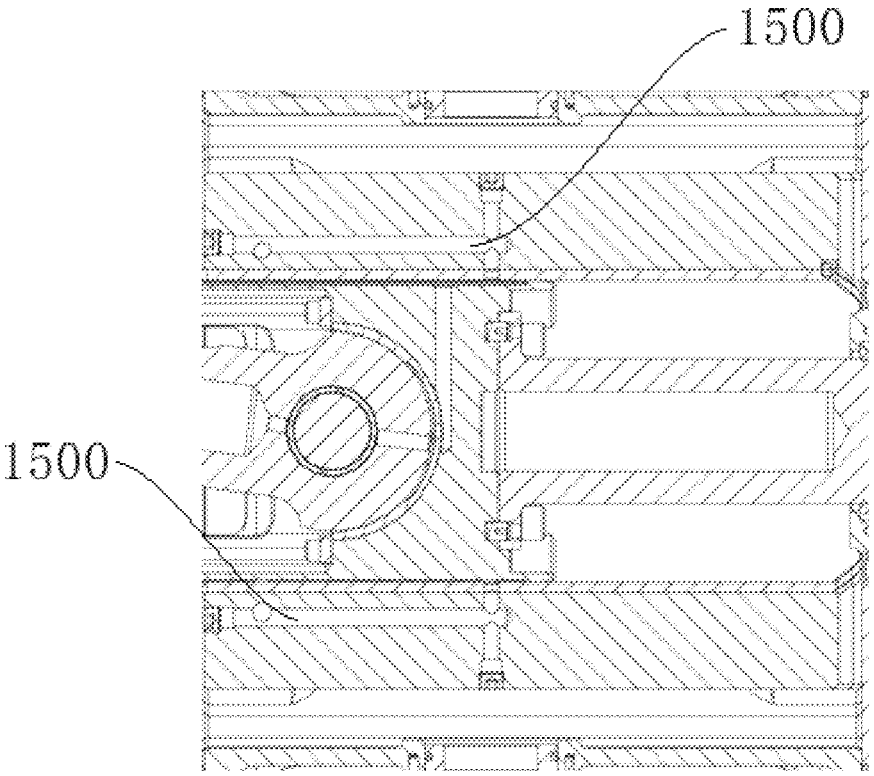
FIG. 24 is a schematic cross-sectional view of an in-line lubricating oil pathway of a crosshead box according to an embodiment of the present disclosure.
Figure 25:
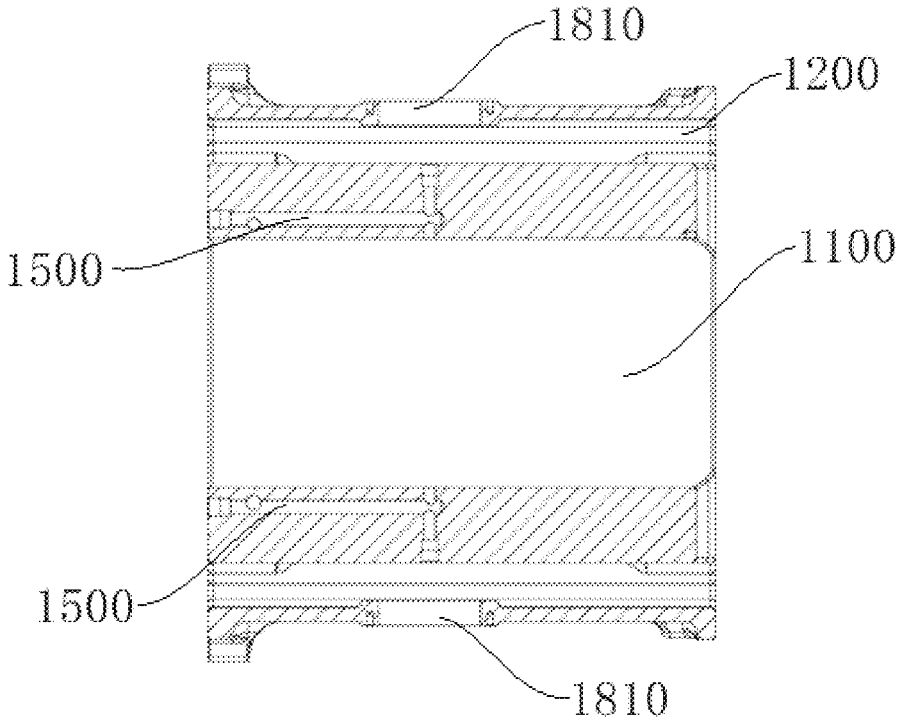
FIG. 25 is a schematic diagram of a processing process of an in-line lubricating oil pathway of a crosshead box according to an embodiment of the present disclosure.
Figure 26:
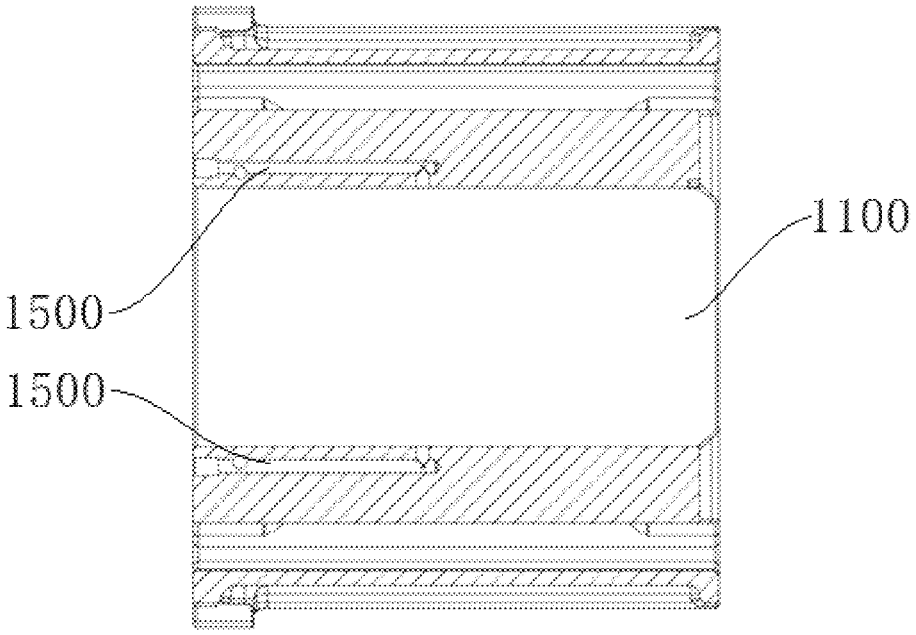
FIG. 26 is a schematic diagram of a processing process of an in-line lubricating oil pathway of a crosshead box according to an embodiment of the present disclosure.

FIG. 24 illustrates a schematic cross-sectional view of an in-line lubricating oil pathway 1500 of the crosshead box 1000 according to an embodiment of the present disclosure. Oil holes and oil channels are machined in the cast casing of the crosshead box 1000, which compared with an external oil pathway, a series of complicated pipeline installation steps are reduced, the overall layout is simpler, and consumption of a large number of lubricating pipes and pipe joints is omitted, thereby ensuring reliable sealing of the lubricating oil and avoiding oil and gas leakage. In arrangement of the primary oil pathway and the branch oil pathway inside the crosshead cavity 1100, a region affected by threaded hole bearing force needs to be avoided, to avoid weakening of the strength of the threaded connection or deformation and blockage of the oil hole caused by screwing of a bolt. In addition, influence on a function of a surrounding structure (for example, the supporting function of the reinforcing beams 1210) also needs to be avoided. As long as the above conditions are met, the angle, extension direction, and number of oil pathways can be flexibly designed according to lubricating requirements. As shown in FIG. 25, the lubricating oil pathway 1500 may be formed by machining a through hole downward through an auxiliary hole/an observation window 1810 to be described below, or can be formed by drilling a right-angle drill from the inside to the outside in the crosshead cavity 1100, as shown in FIG. 26. The in-line oil channel may also be formed in other methods according to actual requirements.

In a working state, the crosshead assemblies reciprocate in the crosshead box 1000 at a high speed, and a plurality of parts need lubrication by a lubricating liquid to work normally. Due to different working conditions of different parts, required amounts and flow rates of the lubricating oil are also different. Therefore, a high-pressure lubricating oil pathway 1510 and a low-pressure lubricating oil pathway 1520 need to be configured separately. For example, the high-pressure lubricating oil pathway 1510 lubricates crosshead bearing pads and connecting rod bearing pads that work in the crosshead box 1000 in a working state, and the low-pressure lubricating oil pathway 1520 lubricates the crosshead sliding sleeve 1400. The high-pressure lubricating oil pathway 1510 is, for example, rated at a lubricating oil pressure of 200-350 PSI, and the low-pressure lubricating oil pathway 1520 is, for example, rated at a lubricating oil pressure of 60-150 PSI.

Figure 27:
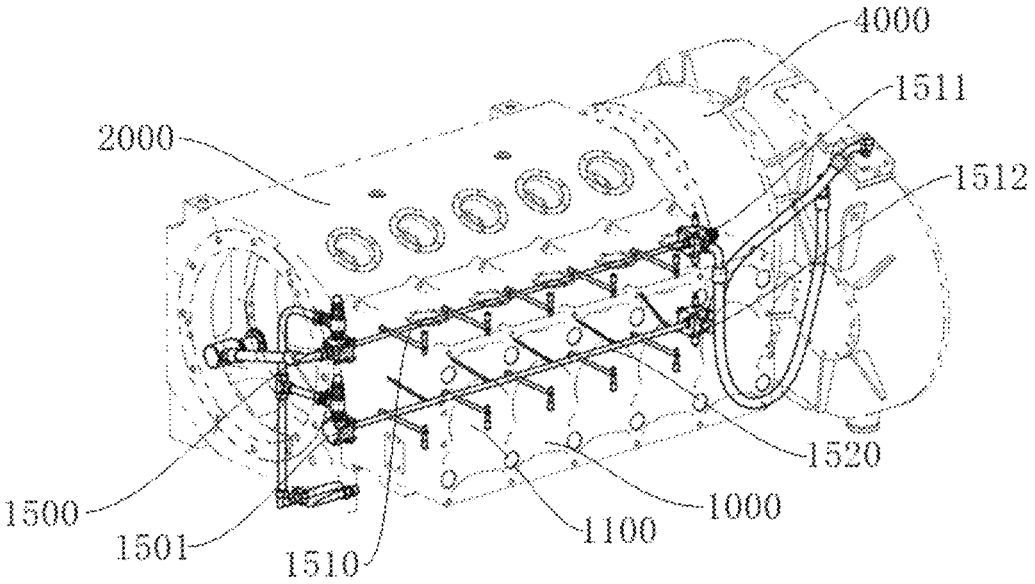
FIG. 27 is a schematic diagram of an overall layout of an in-line lubricating oil pathway of a crosshead box according to an embodiment of the present disclosure.
Figure 28:
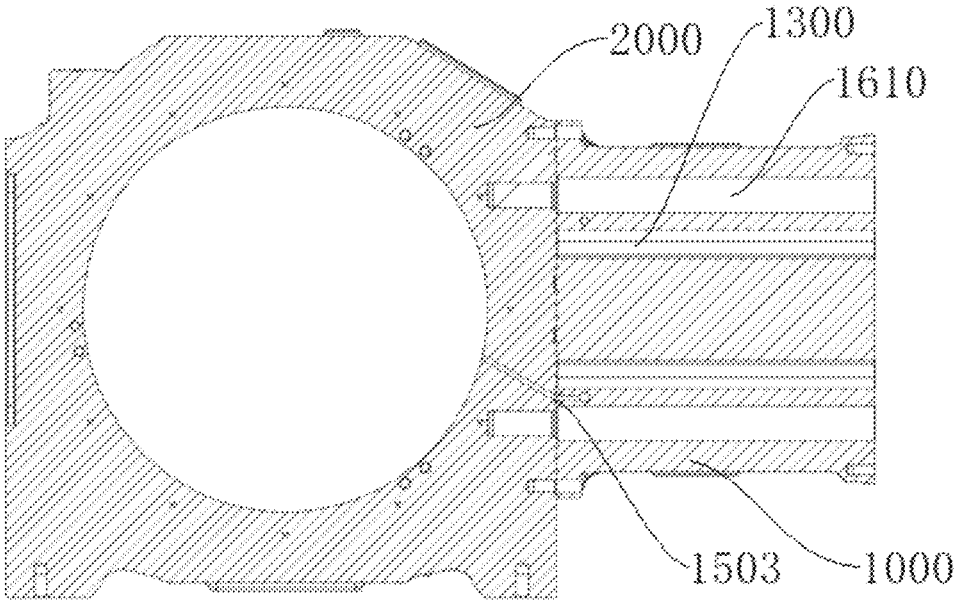
FIG. 28 is a schematic diagram of an alignment position of an oil outlet of an in-line lubricating oil pathway of a crosshead box according to an embodiment of the present disclosure.
Figure 29:
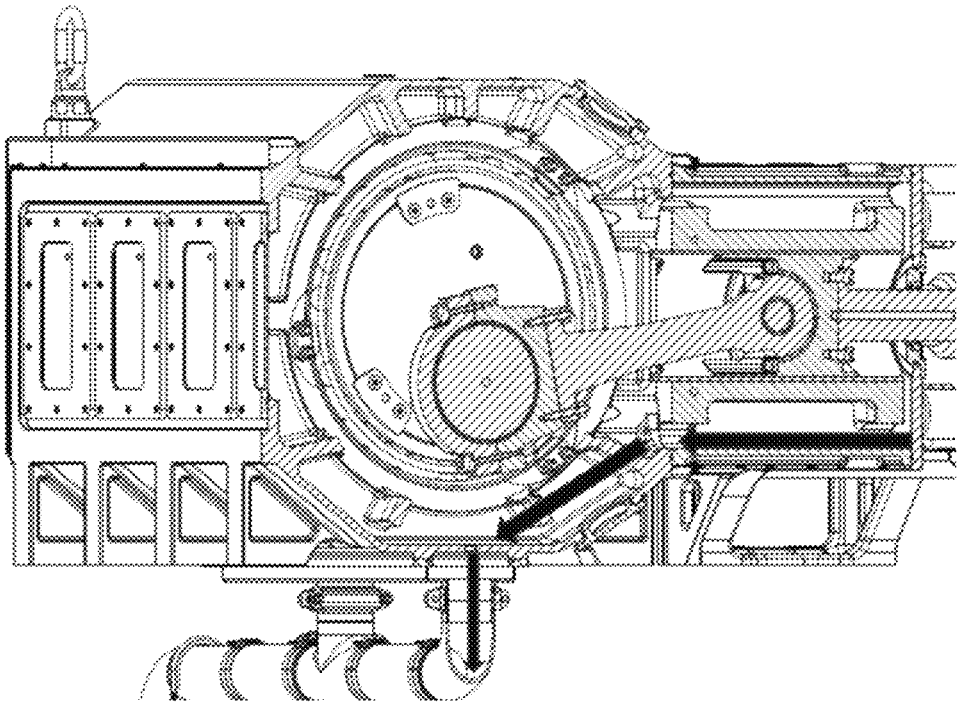
FIG. 29 is a schematic diagram of a lubricating oil recovery path of an in-line lubricating oil pathway of a crosshead box according to an embodiment of the present disclosure.

FIG. 27 illustrates a schematic view of an overall layout of an in-line lubricating oil pathway 1500 of a crosshead box 1000 according to an embodiment of the present disclosure. In FIG. 27, in order to clearly illustrate the layout of the in-line lubricating oil pathway, illustration of some parts in the crosshead box 1000 such as the sliding sleeve 1400 is omitted. As shown in FIG. 27, in the crosshead box 1000 according to this embodiment of the present disclosure, the lubricating oil pathways 1500 are each an in-line oil pathway formed by drilling in the box body of the crosshead box 1000. That is, the in-line lubricating oil pathway 1500 of the crosshead box 1000 according to this embodiment of the present disclosure does not require additional pipeline parts such as an oil pipe and corresponding connecting parts and scaling parts. In this embodiment shown in FIG. 27, the low-pressure lubricating oil pathway 1520 and the high-pressure lubricating oil pathway 1510 each include a primary oil pathway and a branch oil pathway. The primary oil pathway is an oil pathway extending in the transverse direction (that is, the direction extending between the two side end surfaces) of the crosshead box 1000 as shown in the figure, and the primary oil pathway is connected to an oil inlet. Oil pathways branched from the primary oil pathway in the longitudinal direction of the crosshead box 1000 (that is, the extending direction of the crosshead cavity) are branch oil pathways for supplying the oil in the primary oil pathway to corresponding objects to be lubricated, respectively. In this embodiment, the lubricating oil of the low-pressure oil pathway is injected from a low-pressure oil inlet 1512 located on the side of the crosshead box 1000 (the side close to the reduction gearbox 4000 in the figure). One part of the low-pressure lubricating oil in the in-line oil pathway flows to crosshead sliding sleeves 1400 in five crosshead cavities 1100 to lubricate sliding sleeves and small end bearing assemblies of connecting rods (the low-pressure branch oil pipe flowing to the right in FIG. 27). The other part of the low-pressure lubricating oil flows to the rear end surface of the crosshead box 1000 (the low-pressure branch oil pipe to the left in FIG. 27), and then flows into an oil pathway of the crankcase to lubricate a roller bearing and a bearing seat. For this part of the branch oil pathway, as shown in FIG. 28, the position of the oil outlet 1503 at the rear end of the crosshead box 1000 to the outside of the crosshead box 1000 needs to be aligned with the position of the oil inlet of an outer ring of the crankshaft bearing. For the high-pressure lubricating oil pathway 1510, as shown in FIG. 27, the oil is fed from the high-pressure oil inlet 1511 on the side surface of the crosshead box 1000 (the side close to the reduction gearbox 4000 in the figure), flows into the crossheads through an oil channel, and then enters the small ends of the connecting rods through oil channels inside the crossheads along with the swing of the connecting rods, to lubricate the small end bearing pads. As shown in FIG. 29, the lubricating oil in the crosshead box 1000 flows into the bottom of the crosshead box 1000 through design gaps between the front and rear ends of the sliding sleeve, the spacer frame rear end plate, and the crankcase front end plate separately, then flows into an oil pan of the crankcase, and finally flows, through an oil return pipe, back to an oil sump at the bottom of the crankcase.

Figure 30:
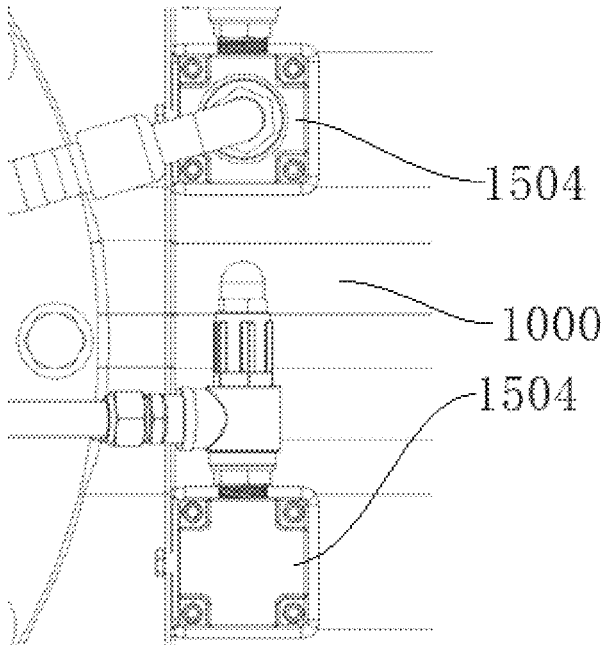
FIG. 30 is a schematic diagram of a structure of an oil injection hole of a lubricating oil pathway of a crosshead box according to an embodiment of the present disclosure.

As shown in FIG. 30, the high-pressure oil inlet 1511 and the low-pressure oil inlet 1512 provided on the side end plate of the crosshead box 1000 are each provided with a boss structure 1504, to provide a flat connecting plane protruding from the side end plate. For convenience of illustration, FIG. 30 shows only a part of the side surface of the crosshead box 1000 in the vicinity of the oil injection hole. A fillet transition is used around the boss structure 1504, to improve the rigidity of the connection. The position and number of oil injection holes are not limited, as long as the oil injection holes correspond to in-line oil channels and the other structures and functions are not affected. As shown in FIG. 30, the crosshead box 1000 and the external oil pipe are preferably connected by flanges, the interface is convenient to replace, the risk of thread fracture in the inner thread connection used in the past is avoided, and the sealing performance is guaranteed. According to actual requirements, other connection methods such as common threaded connection can also be selected.

As shown in FIG. 27, the high-pressure oil pathway and the low-pressure oil pathway are each provided with a filter, a relief valve 1501, and the like. When the oil pressure in the in-line oil channel of the lubricating oil pathway 1500 is higher than a set pressure, the relief valve 1501 overflows part of the oil, to maintain the lubricating oil pressure at the set pressure. The overflow lubricating oil is connected to the oil return pipe through the oil pipe, and finally flows to the oil sump together for recovery, filtration, and cooling, so as to achieve the purpose of recycling of the lubricating oil. For example, both the filter and the relief valve 1501 are provided at the other side end plate 1005 of the crosshead box 1000 opposite to the side end plate 1005 provided with the oil inlet.

In the crosshead box 1000 according to this embodiment of the present disclosure, the oil is injected from the side surface of the crosshead box 1000, the primary oil pathway of the in-line oil pathway in the crosshead box 1000 is designed into a plurality of branches to supply oil to the crosshead box 1000 and the crankcase 2000, which reduces the volume occupied by the in-line oil pathway in the casing and avoids thinning of the box wall caused by an excessively large number of oil pathways. Therefore, the rigidity of the casing can be ensured while reducing the difficulty of the process. In addition, by supplying oil using two oil pumps (a high-pressure pump and a low-pressure pump), the oil supply of each oil pathway can be better guaranteed, so that the lubricating oil can be better distributed, and the problems of uneven distribution of lubricating oil and insufficient amounts of lubricating oil at the lubricating points caused by an excessive large number of lubrication branches can be avoided, thereby improving the utilization rate of the lubricating oil, reducing abnormalities, and better assisting the continuous and stable operation of high-power plunger pumps.

In addition, it should be noted that, in addition to the foregoing method, the lubricating oil pathway of the crankcase 2000 may alternatively not be supplied from the crosshead box 1000, and instead, a hole is separately provided on the side of the crankcase to inject oil, thereby forming an independent oil pathway. By the method, the hole processing process, the external pipeline, and the oil inlet interface are added, which increases the area occupied by the internal oil channels in the casing of the crankcase 2000, and affects the rigidity of the crankcase. In addition, sealing units need to be added at the internal and external pipeline interfaces, to prevent oil and gas leakage and pollution. The oil inlet of the crankcase can be provided at the upper portion or the lower portion of the crankcase, and can also be provided at the left side or the right side of the crankcase. The oil pathway may then undergo a transverse or longitudinal change in position.

6. Connection and Sealing Design

6.1 Connection Design

Figure 31:
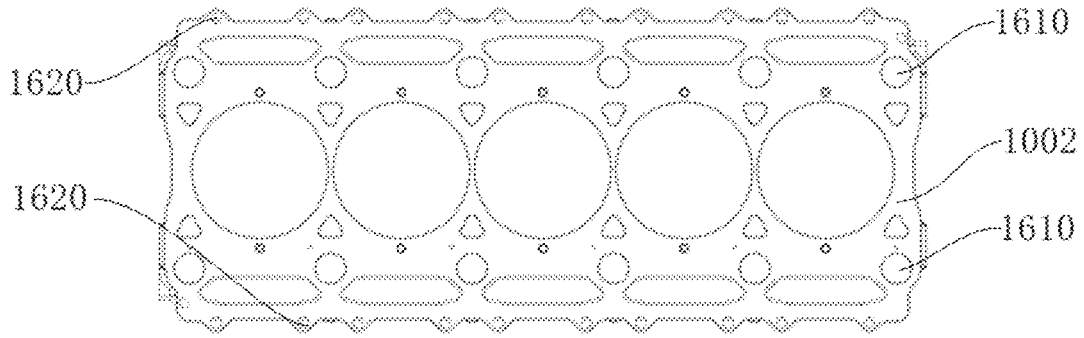
FIG. 31 is a schematic diagram of an end surface, of a crosshead box, to be connected to a crankcase according to an embodiment of the present disclosure.
Figure 32:
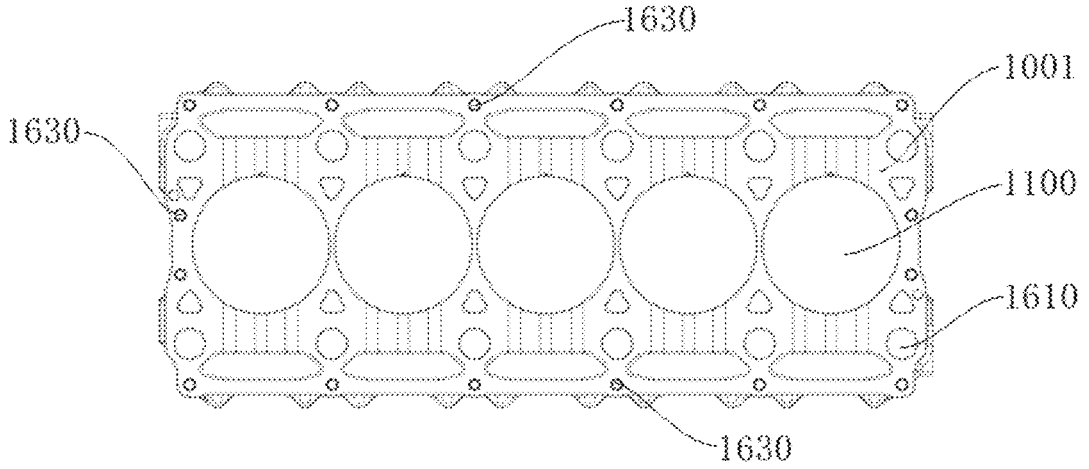
FIG. 32 is a schematic diagram of an end surface, of a crosshead box, to be connected to a spacer frame according to an embodiment of the present disclosure.
Figure 33:
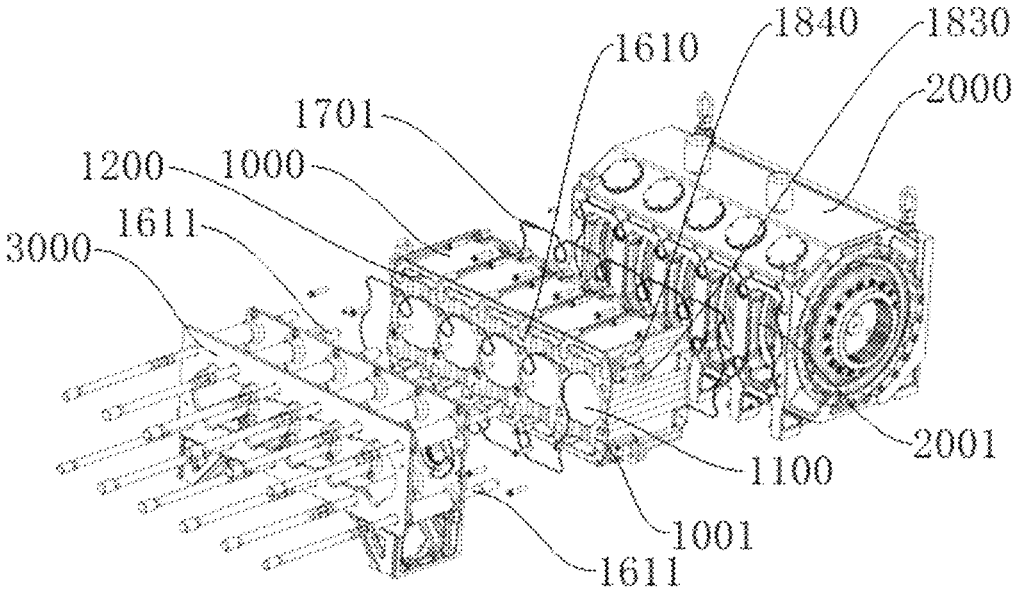
FIG. 33 is a schematic exploded view of connection and assembling of a crosshead box, a crankcase, and a spacer frame according to an embodiment of the present disclosure.

In an assembled operation state of the fracturing pump, one end of the crosshead box 1000 is connected to the crankcase 2000, and the other end is connected to the spacer frame 3000. As shown in FIG. 31 and FIG. 32, preferably, the crosshead box 1000 is connected to the crankcase 2000 and the crosshead box 1000 is connected to the spacer frame 3000 both by using double bolts. First bolt fastening is integral fixing and pre-tightening by a first bolt 1611 (long bolt). As shown in FIG. 33, the long bolt passes through a first-course bolt hole 1610 provided in the crosshead box 1000, and extends to the crankcase 2000 and the spacer frame 3000, so as to connect a hydraulic end and a power end of the fracturing pump. A proper initial axial force is set for the long bolt, to ensure that joint surfaces between the hydraulic end and the power end bolt are always in a connected state during the operation of the plunger pump. A second bolt used between the crosshead box 1000 and the crankcase 2000 and a third bolt used between the crosshead box 1000 and the spacer frame 3000 mainly have functions of sealing and fastening. Therefore, the first bolt 1611 may be referred to as a fastening bolt or a first-course bolt, and the second bolt and the third bolt may be collectively referred to as a scaling bolt or a second-course bolt. It may be understood that the method for connecting the crosshead box 1000 and the crankcase 2000 or the spacer frame 3000 is not limited to the threaded connection described above, and any connection method that ensures tight connection between two members and no relative displacement may be used. For example, an external clamping structure is used to tightly clamp and position two contact surfaces, or electromagnetic connection, hydraulic connection, automatic connection hook, and the like are used. In addition, the arrangement positions and the numbers of first-course bolts and second-course bolts are not limited to the preferable embodiment described herein, and may be changed according to the fastening and scaling requirements.

First-course bolt holes 1610 (that is, long bolt holes) for the first bolts 1611 correspond in position and number to threaded connecting holes 2000 of the crankcase. The second-course bolt holes 1620 for the second bolts and third bolt holes 1630 for the third bolts should in principle be located away from the first-course bolt holes 1610 and at a thin wall protruding from the box body of the crosshead box 1000. The method for forming the protruding thin wall is not limited, and preferably, fillet transition is used in consideration of the convenience of casting and the improvement of the rigidity at the root. In this way, the influence of the pre-tightening force of the first bolts 1611 on the second bolts and the third bolts can be minimized, so that the sealing of the second bolts and the third bolts can be ensured. FIG. 31 illustrates a schematic diagram of the arrangement of the first-course bolt hole 1610 and the second-course bolt hole 1620 in the rear end surface of the crosshead box 1000, and FIG. 32 illustrates a schematic diagram of the arrangement of the first-course bolt hole 1610 and the third bolt hole 1630 in the front end surface of the crosshead box 1000. As shown in the figure, the first-course bolt hole 1610 is provided at a position between two adjacent crosshead cavities 1100 and two adjacent exhaust chambers 1200, and is located on an outer side of the multi-functional structural hole 1300. Preferably, the centers of the first-course bolt hole 1610 and the multi-functional structural hole 1300 are aligned with each other. In addition, as shown in the figures, in the crosshead box 1000 according to this embodiment of the present disclosure, the numbers and arrangements of the second-course bolt holes 1620 at the rear end and the third bolt holes 1630 at the front end of the crosshead box 1000 may be different. The connecting side (that is, the rear end surface) of the crosshead box 1000 and the crankcase 2000 are connected by using two rows of relatively large bolts. For example, flange portions may be provided on the upper and lower sides of the rear end of the crosshead box 1000, and the second-course bolt holes 1620 may be provided in the flange portions. In addition, on the side (that is, the front end surface) where the crosshead box 1000 is connected to the spacer frame 3000, one round of small bolts are disposed for connection. For example, flange portions may be provided on the upper, lower, left, and right sides of the front end of the crosshead box 1000, and the third bolt holes 1630 are provided in the flange portions. Ranges of reciprocating movements of the crossheads in the crosshead box 1000 are more inclined to the side of the crankcase 2000, and therefore a supporting reaction force of the bolts acting on the side of the crankcase 2000 is larger, and the bending moment force arm is shorter. In addition, the rigidity of both the crankcase 2000 and the crosshead box 1000 is large, and the left and right sides of the connecting surface are hardly deformed and separated. Therefore, two rows of large bolts are arranged only up and down to bear the larger axial force. However, the rigidity of the connecting end surfaces of the crosshead box 1000 and the spacer frame 3000 is low, the force arm is long, and there is a particular amount of deflection deformation; and therefore, deformation and separation may occur on two transverse sides of the connecting end surfaces. Therefore, bolts are added on the left and right sides, to ensure the fitness between the contact surfaces. It should be understood that the second-course bolt hole 1620 and the third bolt hole 1630 are not necessarily provided in the flange portions, and can be provided in other positions as long as the holes are located at positions outside the first-course bolt hole 1610 and suitable for forming an anti-loosening fastening structure together with the first-course bolt hole. For example, the second-course bolt hole 1620 and the third bolt hole 1630 may alternatively be provided in recessed portions on the upper mask and the lower mask of the crosshead box. Both the second-course bolt hole and the third bolt hole are located outside the first-course bolt hole and have similar functions, and therefore the first-course bolt hole may also be referred to as an inner bolt hole, and the second-course bolt hole and the third bolt hole are collectively referred to as an outer bolt hole.

6.2 Seal Design

Figure 34A:
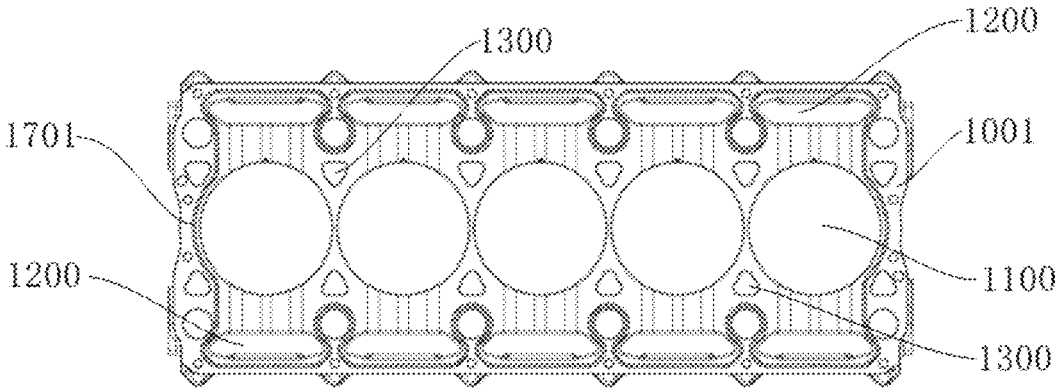
FIG. 34*a* and FIG. 34*b* are schematic diagrams of arrangements of connecting sealing members of a crosshead box, a crankcase, and a spacer frame according to an embodiment of the present disclosure.
Figure 34B:
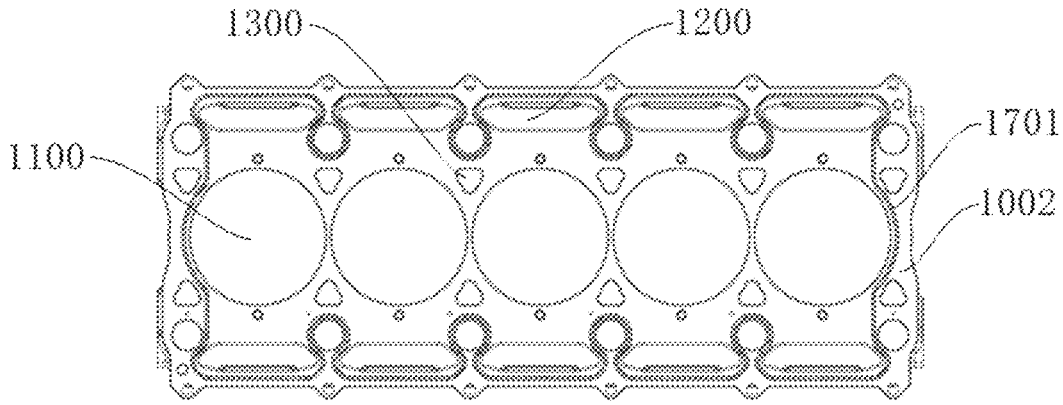

The front and rear end surfaces 1002 of the crosshead box 1000 are connected to the spacer frame 3000 and the crankcase 2000, respectively, and therefore seal design needs to be performed at the front and rear end surfaces 1002. For example, by a sealing means such as providing a sealing structure, for example, a sealing groove, or using a sealant, the crosshead cavity 1100 and the exhaust chamber 1200 are sealed, so as to ensure oil and gas sealing between the two sides of the crosshead box 1000 and the spacer frame 3000 and the crankcase 2000. FIG. 33, FIG. 34*a*, and FIG. 34*b* illustrate an arrangement example of sealing rings 1701 on the front and rear end surfaces of the crosshead box 1000. The positions of the sealing grooves and the sealing rings 1701 of the crosshead box 1000, and the positions of the sealant and other multiple sealing means are not particularly limited, as long as the crosshead cavities 1100 and the exhaust chambers 1200 are ensured to be contained in the sealing region, the sealing requirements of an oil and gas sealing surface in the technical art are met, and the structures and functions of the other peripheral structures are not affected.

Figure 35:
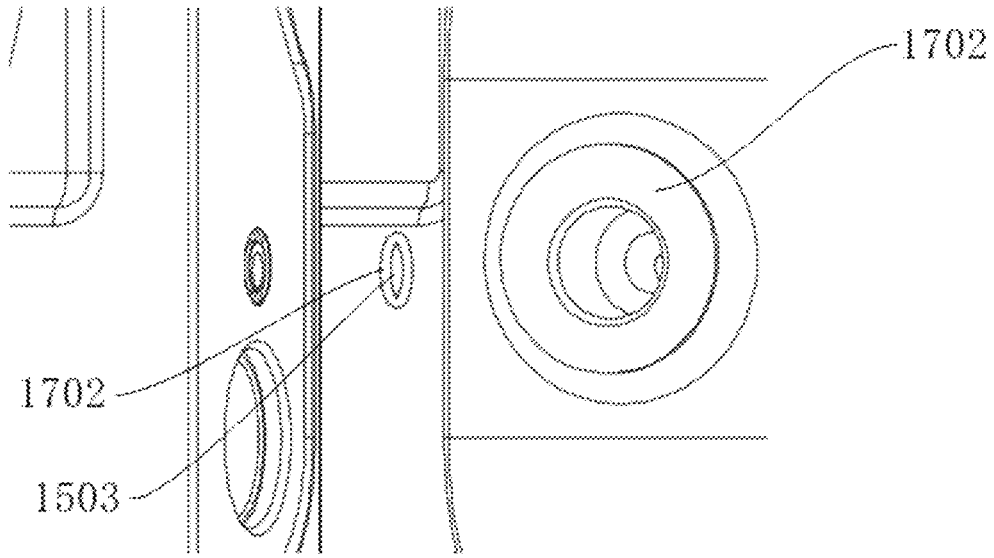
FIG. 35 is a schematic diagram of a partial seal around an oil outlet of a lubricating oil pathway of a crosshead box according to an embodiment of the present disclosure.

A partial sealing member 1702 may be added at the junction of the lubricating oil pathways between the contact surfaces of the crosshead box 1000 and the crankcase 2000. FIG. 35 illustrates a sealing ring, serving as the partial sealing member 1702, provided in peripheries of the oil outlet 1503 of the lubricating oil pathway. The sealing range of the partial scaling member 1702 is not limited, as long as the sealing requirement at the oil port is met. The form of the sealing member is likewise not particularly limited, and may be, for example, a scaling ring (the shape is not limited), or a sealant.

Figure 36:
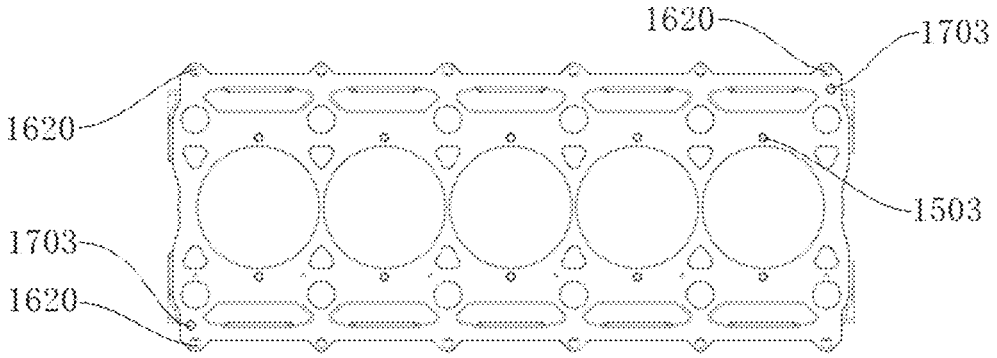
FIG. 36 is a schematic diagram of connection and positioning of a crosshead box, a crankcase, and a spacer frame according to an embodiment of the present disclosure.

In addition, as shown in FIG. 36, a pair of positioning pin holes 1703 are provided on both side end surfaces of the crosshead box 1000, for connection with positioning pins during assembling of the crosshead box 1000 with the spacer frame 3000 and the crankcase 2000, so as to implement mutual alignment and positioning of the crosshead box 1000, the spacer frame 3000, and the crankcase 2000 (only one end surface is shown in FIG. 36). Corresponding pin holes are also provided in the crankcase 2000 and the spacer frame 3000. The positioning pin hole 1703 corresponds to the positioning pin in size and shape. The positions of the positioning pin holes 1703 are not limited, as long as the positioning requirements are met and the surrounding structures and functions are not affected. Preferably, the positioning pin holes are provided at the opposite corners of the end surface, to facilitate positioning.

7. Other Structural Parts of the Crosshead Box

7.1 Auxiliary Hole and/or Observation Window

Figure 37:
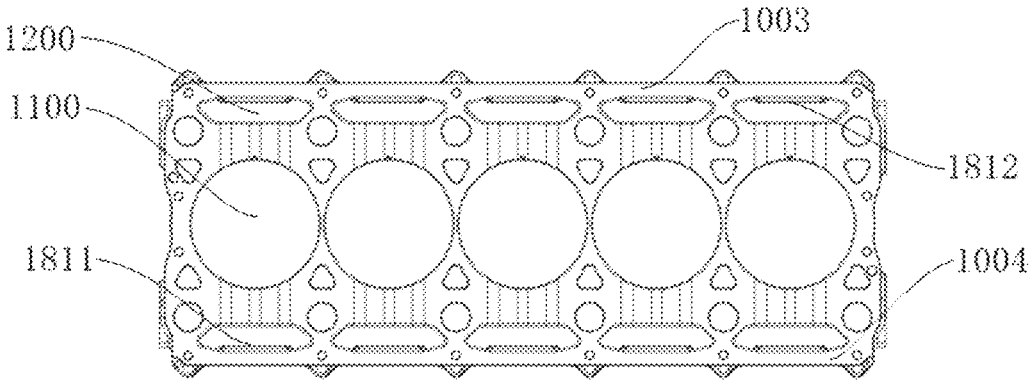
FIG. 37 is a schematic diagram of a structure of an auxiliary hole and/or an observation window of a crosshead box according to an embodiment of the present disclosure.
Figure 38:
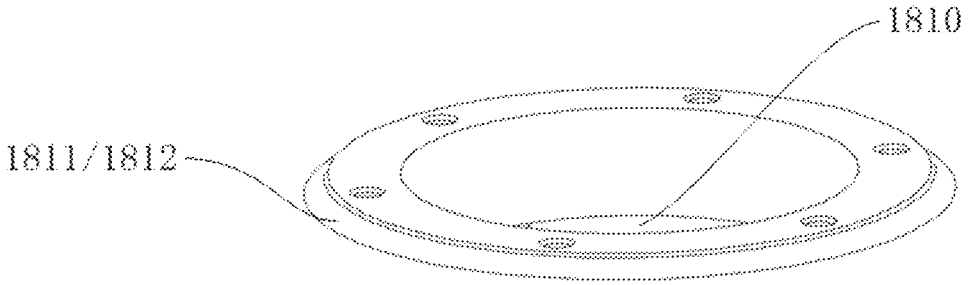
FIG. 38 is a partial enlarged view of a structure of a boss of an auxiliary hole and/or an observation window of a crosshead box according to an embodiment of the present disclosure.

A number of auxiliary holes and/or observation windows 1810 are also provided in the crosshead box 1000. Both the auxiliary holes and the observation windows are provided by running through the casing of the crosshead box 1000 and are similar in function and structure, and therefore the auxiliary holes and the observation windows may also be collectively referred to herein as auxiliary holes. For example, the upper mask 1003 and/or the lower mask 1004 may be provided with auxiliary holes and/or observation windows 1810, for processing of internal oil channels or other processes after the casing is performed and for maintenance and overhaul in later use. As can be seen from the drawings, preferably, the auxiliary holes and/or the observation windows 1810 are provided in the upper mask 1003 and/or the lower mask 1004 at positions corresponding to the crosshead cavities 1100, to facilitate future maintenance and overhaul. In addition, as described above, preferably, the auxiliary holes and/or the observation windows 1810 are provided in positions close to the in-line oil pathway 1500, so as to facilitate the processing and maintenance of the oil pathway. In the crosshead box 1000 according to this embodiment of the present disclosure, the bottom of the crosshead box 1000 has lubricating oil that flows to the crankcase 2000 for recovery, and therefore, as shown in FIG. 37, the auxiliary holes and/or the observation windows 1810 provided in the lower mask 1004 of the crosshead box 1000 are each provided with an upward raised structure 1811 such as a boss protruding toward the inside of the box. By providing the upward raised structure, the lubricating oil at the bottom of the crosshead box 1000 can be prevented from flowing out of the hole to cause environmental pollution. By such the upward raised structure 1811, the screwing length of the fixing bolt can also be increased, and the fastening performance there can be enhanced. In addition, for an upper auxiliary window provided on the upper mask 1003 of the crosshead box 1000, a downward raised structure 1812 protruding toward the inside of the box body may be used to increase the screwing length of the fixing bolt and enhance the fastening performance there. A worker stands above the crosshead box 1000 during equipment maintenance, and in consideration of safety operation and reduction of the possibility of tripping of the worker, no upward raised structure is provided there. FIG. 38 illustrates a schematic structure of a boss of an upward raised structure 1811 or a downward raised structure 1812 formed by the auxiliary hole and/or the observation window 1810. In the figure, the other parts are omitted for clarity of illustration. If another method is used to collect the lubricating oil, the auxiliary hole/the observation window at the bottom may be designed into another structure. The number of auxiliary holes/observation windows is not limited, the shape is not limited to circular, and the disposition position is not limited, as long as post-processing is not blocked. In addition, according to actual requirements, the auxiliary holes/observation windows can also be processed in other methods or no auxiliary hole/observation window is provided.

7.2 Mounting Boss and Related Design

Figure 39:
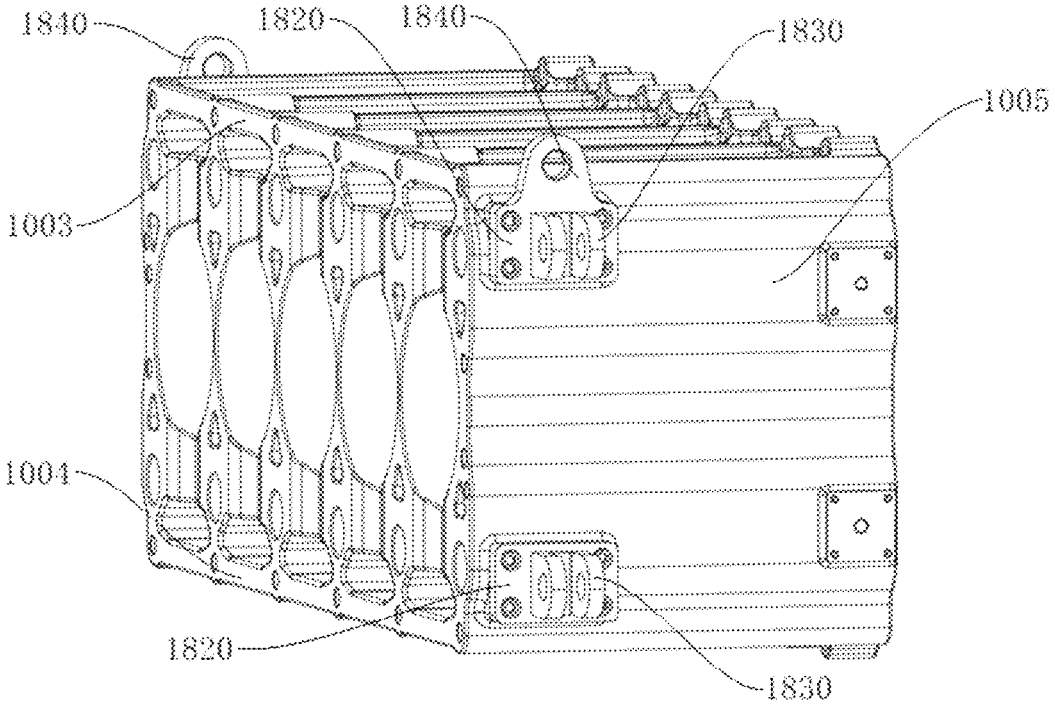
FIG. 39 is a schematic view of a configuration of a mounting boss of a crosshead box and a supporting lug plate and a hoisting lug plate mounted thereon according to an embodiment of the present disclosure.

On both sides of the crosshead box 1000, mounting planes for arranging a hoisting lug plate and a supporting lug plate are provided on the side end plates 1005. For example, as shown in FIG. 39, such the mounting plane may be in a form of a mounting boss 1820. The mounting boss 1820 is integrally formed with the main body of the crosshead box 1000, and the circular arc or groove is arranged in the surroundings for transition, to increase the rigidity at the root. The position, number, and cross-sectional shape of the mounting bosses 1820 are determined according to the disposition requirements of the hoisting lug plates and the supporting lug plates. In addition to the mounting boss 1820 (convex plane), the mounting plane (concave plane) can also be provided by thinning at the hoisting site according to an actual situation.

7.3 Supporting Lug Plate

The crosshead box 1000 according to an embodiment of the present disclosure is further provided with a supporting lug plate 1830. As shown in FIG. 39, the supporting lug plate 1830 according to this embodiment is mounted on the mounting boss 1820, and is disposed on the side, of the rear end of the crosshead box 1000, close to the reduction gearbox, for connecting a screw supporting assembly of the reduction gearbox. By proper position arrangement of the supporting lug plates 1830, deformation of the reduction gearbox toward the power transmission shaft and the gravity direction can be effectively reduce, so that the rigidity of the casing of the reduction gearbox is improved. The position, number, and cross-sectional shape of the supporting lug plates 1830 are not limited, as long as the supporting lug plates 1830 are fitted with the screw supporting assemblies.

7.4 Hoisting Lug Plate

The crosshead box 1000 according to an embodiment of the present disclosure is also provided with a hoisting lug plate 1840. As shown in FIG. 39, the hoisting lug plate 1840 according to this embodiment is mounted on the mounting boss 1820 located at the upper portion of the box body. During disassembling at the hydraulic end, the hoisting lug plate 1840 can be used in a hoisting operation of the crosshead box 1000 and a crankcase assembly or a hoisting operation of the crosshead box 1000. The shape, position, and number of the hoisting lug plates 1840 are not limited, as long as the force is even and the crosshead box 1000 does not tilt during the hoisting. The method for forming the hoisting lug plate 1840 is not limited, and integral forming or processing such as casting can be used. In the embodiment shown in FIG. 39, the hoisting lug plate 1840 and the supporting lug plate 1830 are integrally formed on the mounting boss located on the upper portion of the crosshead box. By such the structure, the occupied area and the processing steps of the mounting boss 1820 are reduced, thereby saving the costs. It should be understood that the supporting lug plate 1830 and the hoisting lug plate 1840 may also be formed on the mounting bosses 1820 at different positions respectively according to design requirements.

Preferable embodiments of the integrally formed crosshead box according to the present invention have been described in detail above with reference to the accompanying drawings. It should be understood that the integrally formed crosshead box according to the present invention does not necessarily need to have all the technical features shown in the drawings, and these technical features described herein may be combined according to requirements. For example, among the preferable structures of the integrally formed crosshead box according to the present invention described above, the structures such as the exhaust chamber, the in-line oil pathway, and the multi-functional structural hole may be optionally provided according to specific requirements. The structures are not essential structures for achieving the basic function of the integrally formed crosshead box according to the present invention. For example, the integrally formed crosshead box according to the present invention may not use an in-line oil pathway, and an external oil pipe in the prior art is used.

For example, a crosshead box according to an embodiment of the present invention is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with a plurality of exhaust chambers, each of the exhaust chambers running through the crosshead box in the longitudinal direction of the crosshead box and being in communication with the corresponding crosshead cavity.

For example, the crosshead box according to another embodiment of the present invention is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with a plurality of multi-functional structural holes, each of the multi-functional structural holes extending in the longitudinal direction of the crosshead box and running through the box body.

For example, the crosshead box according to still another embodiment of the present invention is a substantially rectangular box body formed by an integral forming process and is provided with a front end surface, a rear end surface, an upper end surface, a lower end surface, and a side end surface, and the crosshead box is provided with: a plurality of crosshead cavities, each of the crosshead cavities extending in a longitudinal direction of the crosshead box and running through the box body, and the plurality of crosshead cavities being arranged in a transverse direction of the crosshead box. The crosshead box is further provided with an in-line lubricating oil pathway, the in-line lubricating oil pathway being oil holes and oil channels formed in a cast casing of the crosshead box and in communication with each other, and the in-line lubricating oil pathway including a primary oil pathway and a branch oil pathway.

In the crosshead box according to the present disclosure, by integral forming by using a casting process and platform design, the versatility and adaptability of parts are improved, thereby greatly reducing the types of accessories in fracturing pumps of different types, and saving the costs for purchase of a large number of accessories and maintenance and overhaul. A conventional tailor-welded casing of the power end needs to be repaired or even scrapped once it is partially cracked, which affects the efficiency of fracturing operations and increases the cost of maintenance. In addition, by the integrally formed crosshead box, not only the strength and rigidity of the casing of the power end is improved and the life and maintenance cycle of the casing is prolonged, but also separate maintenance and replacement of a portion of the casing can be implemented, so that the maintenance difficulty and repair cost are reduced.

In addition, the integrally formed crosshead box according to this embodiment of the present disclosure may be provided with a structure such as a multi-functional structural hole, so that the weight of the box body is reduced while ensuring the structural rigidity. In the integrally formed crosshead box according to this embodiment of the present disclosure, a dedicated exhaust chamber and fluid channel may be provided, so that the inside of the box body has a good fluid circulation path, and that the air pressure inside the box body can always be maintained in balance during operation, thereby improving the operating stability and prolonging the service life of the equipment. For the lubricating oil pathway of the crosshead box according to this embodiment of the present disclosure, an in-line structure may be used to replace a conventional external oil pipe for arrangement, so that a large number of flexible hoses and pipe joints are omitted, thereby greatly alleviating the oil pressure leakage problem caused by potential risks such as pipeline oxidation corrosion and pipe joint loosening. Therefore, the maintenance cycle of the lubrication system can be effectively extended and fault detection and maintenance can be facilitated.

Both sides of the crosshead box according to the present disclosure are designed with hoisting points, to facilitate individual hoisting and hoisting in combinations. By the cylindrical crosshead cavities of the crosshead box, a cylindrical crosshead sliding sleeve can be used to replace a two-piece bearing pad, which reduces the mounting steps and facilitates the inspection and replacement of the bearing pad. The crosshead box is also provided with sensors to monitor, in real time, vibration of the equipment, a temperature of the casing, a temperature and a flow rate of the lubricating oil, and other data, so that an on-site personnel can find and make response actions, such as a shutdown inspection and replacement of components in time when the equipment is abnormal in the initial stage.

In addition, the crosshead box according to the present disclosure may be configured as, but not limited to, the configurations in the following.

(1) A crosshead box, where the crosshead box is a substantially rectangular box body formed by an integral forming process and is provided with a front end surface, a rear end surface, an upper end surface, a lower end surface, and a side end surface, and the crosshead box is provided with:

a plurality of crosshead cavities, each of the crosshead cavities extending in a longitudinal direction of the crosshead box and running through the box body, and the plurality of crosshead cavities being arranged in a transverse direction of the crosshead box, where the crosshead box is further provided with a plurality of exhaust chambers, each of the exhaust chambers running through the crosshead box in the longitudinal direction of the crosshead box and being in communication with the corresponding crosshead cavity.

(2)

The crosshead box according to (1), where a fluid channel is formed in the front end surface of the crosshead box, the fluid channel being a groove that is recessed inwardly from the front end surface in the longitudinal direction of the crosshead box and extends from the crosshead cavities to the exhaust chambers.

(3)

The crosshead box according to (2), where the exhaust chambers and the corresponding crosshead cavities are in fluid communication via the fluid channel, so that when crosshead assemblies move in the crosshead cavities in a direction from the front end surface to the rear end surface, an air flow in the exhaust chambers moves in a direction from the rear end surface to the front end surface, and when the crosshead assemblies move in the crosshead cavities in the direction from the rear end surface to the front end surface, the air flow in the exhaust chambers moves in the direction from the front end surface to the rear end surface.

(4)

The crosshead box according to (2), where the crosshead box is further provided with crosshead sliding sleeves capable of being embedded into the crosshead cavities, and one end of each crosshead sliding sleeve located at the front end surface is provided with at least one inwardly recessed portion in the longitudinal direction of the crosshead box, and an inwardly recessed shape of the inwardly recessed portion matches a shape of a groove of the fluid channel.

(5)

The crosshead box according to (4), where an end of the crosshead sliding sleeve at the rear end surface is provided with at least one protruding portion protruding outwards in a longitudinal direction of the crosshead sliding sleeve.

(6)

The crosshead box according to (1), where one exhaust chamber is provided above or below each of the crosshead cavities.

(7)

The crosshead box according to (1), where one exhaust chamber is provided above and below each of the crosshead cavities.

(8)

The crosshead box according to (7), where one crosshead cavity and the two exhaust chambers located above and below the crosshead cavity are centrosymmetric in the transverse direction of the crosshead box, and are centrosymmetric in a vertical direction perpendicular to the transverse direction.

(9)

The crosshead box according to (7), where one crosshead cavity and the two exhaust chambers located above and below the crosshead cavity are axial-symmetrical in the transverse direction of the crosshead box, and are axial-symmetrical in a vertical direction perpendicular to the transverse direction.

(10)

The crosshead box according to any one of (1) to (9), where reinforcing beams are formed on inner walls of the exhaust chambers on sides close to the crosshead cavities.

(11)

The crosshead box according to (1), where the crosshead box is further provided with at least one multi-functional structural hole, each of the multi-functional structural holes extending in the longitudinal direction of the crosshead box and running through the box body.

(12)

The crosshead box according to (11), where the multi-functional structural holes are provided at positions close to at least one of the crosshead cavities.

(13)

The crosshead box according to (11), where on the front end surface and the rear end surface, at least one of the multi-functional structural holes is provided at a position between two adjacent crosshead cavities.

(14)

The crosshead box according to (11), where a cross section of each multi-functional structural hole has a polygonal shape.

(15)

The crosshead box according to (14), where on the front end surface and the rear end surface, wall surfaces around the multi-functional structural holes are equal in thickness.

(16)

The crosshead box according to (11), where a cross section of each multi-functional structural hole has a triangular shape having a fillet.

(17)

The crosshead box according to (16), where on the front end surface and the rear end surface, walls between each multi-functional structural hole and two adjacent crosshead cavities have substantially a same thickness.

(18)

The crosshead box according to any one of (1) to (9), where a plurality of partition columns extending up and down are provided between each crosshead cavity, the plurality of partition columns are arranged in a longitudinal direction of the crosshead box, and two adjacent crosshead cavities are in communication with each other through a gap between the partition columns.

(19)

The crosshead box according to any one of (1) to (9), where each crosshead cavity has a substantially cylindrical shape.

(20)

The crosshead box according to any one of (11) to (17), where the crosshead box further includes crosshead sliding sleeves, and each of the crosshead sliding sleeves has a shape matching that of the crosshead cavity and is capable of being embedded and mounted in the crosshead cavity.

(21)

The crosshead box according to (20), where the crosshead sliding sleeve is provided with an oil hole running through a wall of the sliding sleeve.

(22)

The crosshead box according to (20), where one end of the crosshead sliding sleeve is provided with at least one inwardly recessed portion in the longitudinal direction of the crosshead sliding sleeve.

(23)

The crosshead box according to (20), where one end of the crosshead sliding sleeve is provided with at least one protruding portion protruding outwards in the longitudinal direction of the crosshead sliding sleeve.

(24)

The crosshead box according to (22), where the other end of the crosshead sliding sleeve is provided with at least one protruding portion protruding outwards in the longitudinal direction of the crosshead sliding sleeve.

(25)

The crosshead box according to (22), where there are two inwardly recessed portions, and in a state in which the crosshead sliding sleeve is mounted in the crosshead cavity, the two inwardly recessed portions are located at the top and bottom of the crosshead cavity.

(26)

The crosshead box according to (23), where there are two protruding portions, and in a state in which the crosshead sliding sleeve is mounted in the crosshead cavity, the two protruding portions are located at the top and bottom of the crosshead cavity.

(27)

The crosshead box according to (24), where there are two inwardly recessed portions and there are two protruding portions, and in a state in which the crosshead sliding sleeve is mounted in the crosshead cavity, the two inwardly recessed portions are located at the top and bottom of the crosshead cavity, and the two protruding portions are also located at the top and bottom of the crosshead cavity.

(28)

The crosshead box according to (20), where the front end surface of the crosshead cavity is provided with a limiting slot, an end portion of the crosshead sliding sleeve at the end of the front end surface is provided with a positioning pin hole, the positioning pin hole and the limiting slot are matched and connected through a pin shaft that is to enter the pin hole, to axially position the crosshead sliding sleeve in the crosshead cavity.

(29)

The crosshead box according to (1), where crosshead box is further provided with an in-line lubricating oil pathway, the in-line lubricating oil pathway being oil holes and oil channels formed in a cast casing of the crosshead box and in communication with each other, and the in-line lubricating oil pathway including at least one primary oil pathway and at least one branch oil pathway.

(30)

The crosshead box according to (29), where the primary oil pathway extends in the transverse direction of the crosshead box and the branch oil pathway extends in the longitudinal direction of the crosshead box.

(31)

The crosshead box according to (29), where the in-line lubricating oil pathway includes a high-pressure lubricating oil pathway.

(32)

The crosshead box according to (31), where the high-pressure lubricating oil pathway lubricates crosshead bearing pads and connecting rod bearing pads that work in the crosshead box.

(33)

The crosshead box according to (31), where the high-pressure lubricating oil pathway includes a high-pressure oil inlet provided on the side end surface of the crosshead box.

(34)

The crosshead box according to (33), where the high-pressure oil inlet is provided on a flat connecting plane formed on the side end surface.

(35)

The crosshead box according to (31), where the high-pressure lubricating oil pathway is provided with a filter and a relief valve.

(36)

The crosshead box according to (29), where the in-line lubricating oil pathway includes a low-pressure lubricating oil pathway.

(37)

The crosshead box according to (36), where the crosshead box is further provided with crosshead sliding sleeves, and each of the crosshead sliding sleeves has a shape matching that of the crosshead cavity and is capable of being embedded and mounted in the crosshead cavity, the low-pressure lubricating oil pathway lubricates the crosshead sliding sleeves.

(38)

The crosshead box according to (36), where the low-pressure lubricating oil pathway includes a low-pressure oil inlet provided on the side end surface of the crosshead box.

(39)

The crosshead box according to (38), where the low-pressure oil inlet is provided on a flat connecting plane formed on the side end surface.

(40)

The crosshead box according to (36), where the low-pressure lubricating oil pathway is provided with a filter and a relief valve.

(41)

The crosshead box according to (29), where the at least one branch oil pathway includes a branch oil pathway for supplying oil to the crankcase, and the branch oil pathway for supplying oil to the crankcase is provided with an oil outlet to the crankcase at the rear end surface of the crosshead box.

(42)

The crosshead box according to (41), where a sealing ring serving as a partial sealing member is provided on an outer periphery of the oil outlet.

(43)

The crosshead box according to any one of (1) to (9), (11) to (17), and (29) to (42), where the crosshead box is further provided with at least one first-course bolt hole, and each of the at least one first-course bolt hole is located above and below the plurality of crosshead cavities and extends in the longitudinal direction of the crosshead box and runs through the box body.

(44)

The crosshead box according to (43), where the crosshead box is further provided with at least one second-course bolt hole, the second-course bolt hole extends in the longitudinal direction of the crosshead box and runs through the box body, and the second-course bolt hole is located on an outer side of the first-course bolt hole on both the front end surface and the rear end surface.

(45)

The crosshead box according to (44), where on the front end surface of the crosshead box, edge portions on two sides of the crosshead box in the transverse direction are also provided with the second-course bolt holes.

(46)

The crosshead box according to (44), where on the front end surface of the crosshead box, a flange portion is provided on an outer periphery of the crosshead box, and the second-course bolt hole is provided in the flange portion.

(47)

The crosshead box according to (44), where on the rear end surface of the crosshead box, a flange portion is provided on each of an upper edge and a lower edge of the crosshead box, and the second-course bolt holes are provided in the flange portions.

(48)

The crosshead box according to any one of (1) to (9), (11) to (17), and (29) to (42), where the front end surface and the rear end surface of the crosshead box are each provided with a sealing groove, and a sealing region surrounded by the sealing groove includes at least the crosshead cavities and the exhaust chambers.

(49)

The crosshead box according to any one of (1) to (9) and (11) to (17), where the crosshead box further includes an auxiliary hole running through a casing of the crosshead box.

(50)

The crosshead box according to (49), where the auxiliary hole is provided at a position corresponding to the crosshead cavity.

(51)

The crosshead box according to any one of (29) to (42), where the crosshead box further includes an auxiliary hole running through a casing of the crosshead box, and the auxiliary hole is provided at least at a position close to the in-line lubricating oil pathway.

(52)

The crosshead box according to (49), where the auxiliary hole formed in the top of the crosshead box is provided with a downward raised structure protruding toward the crosshead cavity.

(53)

The crosshead box according to (49), where the auxiliary hole formed in the bottom of the crosshead box is provided with an upward raised structure protruding toward the crosshead cavity.

(54)

The crosshead box according to any one of (1) to (9), (11), and (29), where the crosshead box is further provided with a mounting boss formed on the side end surface.

(55)

A plunger pump, including a crankcase, the crosshead box according to any one of (1) to (54), and a spacer frame.

(56)

The plunger pump according to (55), where the crankcase, the crosshead box, and the spacer frame are each provided with a positioning pin hole for aligning and positioning the crankcase, the crosshead box, and the spacer frame.

(57)

The plunger pump according to (55) or (56), where the plunger pump further includes a reduction gearbox, and a supporting lug plate is provided on the mounting boss formed on the side end surface of the crosshead box, and the supporting lug plate is connected to a supporting assembly of the reduction gearbox.

Although the integrally formed crosshead box according to the present disclosure is described above with reference to the drawings, the present invention is not limited to the d embodiments. It should be understood by a person skilled in the art that various changes, combinations, sub-combinations, and modifications can be made without departing from the spirit or scope of the present invention as defined by the appended claims. In addition, the advantageous effects of the present disclosure are also not limited to the effects mentioned above, but may be other effects that can be conceived of by reading the present disclosure.

What is claimed is:

1. A crosshead box for a pump, comprising:

a substantially rectangular box body formed by an integral forming process and provided with a front end surface, a rear end surface, an upper end surface, a lower end surface, and a side end surface;

a plurality of crosshead cavities in the crosshead box, each of the crosshead cavities extending in a longitudinal direction of the crosshead box and running through the box body, and the plurality of crosshead cavities being arranged in a transverse direction of the crosshead box; and a plurality of exhaust chambers in the crosshead box, each of the exhaust chambers running through the crosshead box in the longitudinal direction of the crosshead box and being in communication with a corresponding crosshead cavity of the plurality of crosshead cavities.

2. The crosshead box according to claim 1, wherein a fluid channel is formed in the front end surface of the crosshead box, the fluid channel being a groove that is recessed inwardly from the front end surface in the longitudinal direction of the crosshead box and extends from the crosshead cavities to the exhaust chambers.

3. The crosshead box according to claim 2, wherein the exhaust chambers and the corresponding crosshead cavities are in fluid communication via the fluid channel, so that when crosshead assemblies move from the front end surface to the rear end surface, an air flow in the exhaust chambers moves from the rear end surface to the front end surface, and when the crosshead assemblies move in the crosshead cavities from the rear end surface to the front end surface, the air flow in the exhaust chambers moves from the front end surface to the rear end surface.

4. The crosshead box according to claim 2, further comprising crosshead sliding sleeves capable of being embedded into the crosshead cavities, wherein:

one end of each crosshead sliding sleeve located at the front end surface is provided with at least one inwardly recessed portion in the longitudinal direction of the crosshead box; and an inwardly recessed shape of the inwardly recessed portion matches a shape of a groove of the fluid channel.

5. The crosshead box according to claim 4, wherein an end of each of the crosshead sliding sleeves at the rear end surface is provided with at least one protruding portion protruding outwards in the longitudinal direction of the each of the crosshead sliding sleeves.

6. The crosshead box according to claim 1, further comprising at least one multi-functional structural hole, each of the multi-functional structural holes extending in the longitudinal direction of the crosshead box and running through the box body.

7. The crosshead box according to claim 4, wherein:

the front end surface of each of the crosshead cavities is provided with a limiting slot;

an end portion of the each of the crosshead sliding sleeves at the end of the front end surface is provided with a positioning pin hole;

the positioning pin hole and the limiting slot are matched and connected through a pin shaft inserted in the positioning pin hole, to axially position the each of the crosshead sliding sleeves in a corresponding crosshead cavity.

8. The crosshead box according to claim 1, further comprising an in-line lubricating oil pathway, the in-line lubricating oil pathway being oil holes and oil channels formed in a cast casing of the crosshead box and in communication with each other, and the in-line lubricating oil pathway comprising at least one primary oil pathway and at least one branch oil pathway.

9. The crosshead box according to claim 8, wherein the primary oil pathway extends in the transverse direction of the crosshead box and the branch oil pathway extends in the longitudinal direction of the crosshead box.

10. A crosshead box, comprising:

a substantially rectangular box body formed by an integral forming process and provided with a front end surface, a rear end surface, an upper end surface, a lower end surface, and a side end surface;

a plurality of crosshead cavities in the crosshead box, each of the crosshead cavities extending in a longitudinal direction of the crosshead box and running through the box body, and the plurality of crosshead cavities being arranged in a transverse direction of the crosshead box;

at least one multi-functional structural hole in the crosshead box, each of the at least one multi-functional structural holes extending in the longitudinal direction of the crosshead box and running through the box body; and an in-line lubricating oil pathway, the in-line lubricating oil pathway being oil holes and oil channels formed in a cast casing of the crosshead box and in communication with each other, and the in-line lubricating oil pathway comprising at least one primary oil pathway and at least one branch oil pathway.

11. The crosshead box according to claim 10, wherein, on the front end surface and the rear end surface, at least one of the at least one multi-functional structural holes is located at a position between two adjacent crosshead cavities.

12. The crosshead box according to claim 10, wherein, on the front end surface and the rear end surface, wall portions surrounding each of the at least one multi-functional structural holes are equal in thickness.

13. The crosshead box according to claim 10, wherein the primary oil pathway extends in the transverse direction of the crosshead box and the branch oil pathway extends in the longitudinal direction of the crosshead box.

14. The crosshead box according to claim 10, wherein the in-line lubricating oil pathway comprises a high-pressure lubricating oil pathway and a low-pressure lubricating oil pathway.

15. A crosshead box, comprising:

a substantially rectangular box body formed by an integral forming process and provided with a front end surface, a rear end surface, an upper end surface, a lower end surface, and a side end surface;

a plurality of crosshead cavities in the crosshead box, each of the crosshead cavities extending in a longitudinal direction of the crosshead box and running through the box body, and the plurality of crosshead cavities being arranged in a transverse direction of the crosshead box; and an in-line lubricating oil pathway, the in-line lubricating oil pathway being oil holes and oil channels formed in a cast casing of the crosshead box and in communication with each other, and the in-line lubricating oil pathway comprising a primary oil pathway and a branch oil pathway.

16. The crosshead box according to claim 15, wherein the primary oil pathway extends in the transverse direction of the crosshead box and the branch oil pathway extends in the longitudinal direction of the crosshead box.

17. The crosshead box according to claim 15, further comprising crosshead sliding sleeves, each of the crosshead sliding sleeves having a shape matching that of a corresponding crosshead cavity and is capable of being embedded and mounted in the corresponding crosshead cavity, and the each of the crosshead sliding sleeves is provided with an oil hole running through a wall of the each of the crosshead sliding sleeve, the oil hole being part of the branch oil pathway.

18. The crosshead box according to claim 17, wherein:

the in-line lubricating oil pathway comprises a high-pressure lubricating oil pathway and a low-pressure lubricating oil pathway;

the high-pressure lubricating oil pathway lubricates crosshead bearing pads and connecting rod bearing pads that work in the crosshead box; and the low-pressure lubricating oil pathway lubricates the each of the crosshead sliding sleeves.

19. The crosshead box according to claim 15, further comprising a plurality of exhaust chambers and at least one multi-functional structural hole, wherein the exhaust chambers run through the crosshead box in the longitudinal direction of the crosshead box and are in communication with the corresponding crosshead cavities, and the multi- functional structural holes extend in the longitudinal direction of the crosshead box and run through the box body.

* * * * *